US006743063B2

(12) United States Patent
Gokan

(10) Patent No.: US 6,743,063 B2
(45) Date of Patent: Jun. 1, 2004

(54) DRY SUMP ENGINE FOR A SMALL PLANING BOAT

(75) Inventor: Yoshitsugu Gokan, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/193,312

(22) Filed: Jul. 12, 2002

(65) Prior Publication Data

US 2003/0017767 A1 Jan. 23, 2003

(30) Foreign Application Priority Data

Jul. 19, 2001 (JP) ..... 2001-219323

(51) Int. Cl.[7] ..... B63H 21/38

(52) U.S. Cl. ..... 440/88 L; 123/196 A; 123/196 R; 123/198 C

(58) Field of Search ..... 440/88 L; 123/196 R, 123/198 C, 196 A

(56) References Cited

U.S. PATENT DOCUMENTS 1,820,382 A * 8/1931 Ellis ..... 184/6.24
3,641,964 A * 2/1972 Lee ..... 440/42
5,133,313 A * 7/1992 Inoue et al. ..... 123/195 C
5,887,564 A * 3/1999 Kawamoto ..... 123/196 R
6,460,503 B2 * 10/2002 Kinoshita et al. ..... 123/196 R
2001/0010988 A1 * 8/2001 Suganuma ..... 440/88

FOREIGN PATENT DOCUMENTS

JP 2754371 3/1998

* cited by examiner

*Primary Examiner*—Sherman Basinger
(74) *Attorney, Agent, or Firm*—Birch, Stewart, Kolasch & Birch, LLP

(57) ABSTRACT

A mounting face of an oil pan is provided in the vicinity of the outside of a fastening bolt for fastening un upper case and a lower case of an engine that support a crankshaft when viewed from the bottom. A strainer is provided in the vicinity of the engaging surface between the oil pan and the engine along the engaging surface. An oil pump is provided at the end of the crankshaft. An oil exit in communication with the oil pump is provided on the oil pan at the end in the axial direction of the crankshaft and is brought into communication with the oil pump by the joint pipe. The aforementioned arrangement provides a dry-sump engine for a small planing boat that can reduce the overall height and size of the engine.

11 Claims, 24 Drawing Sheets

FIG. 14(a)
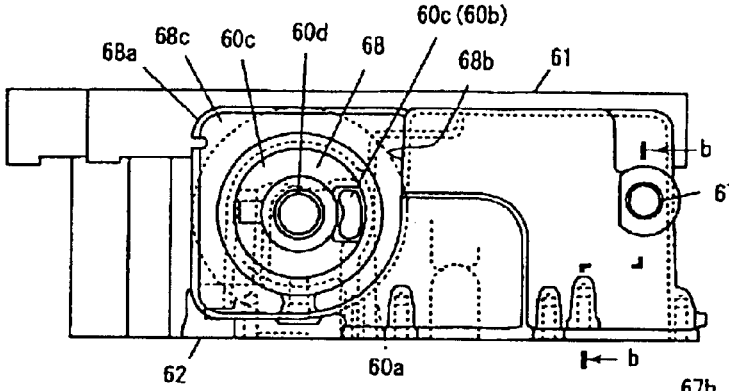
FIG. 14(d)
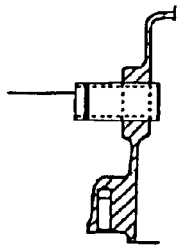
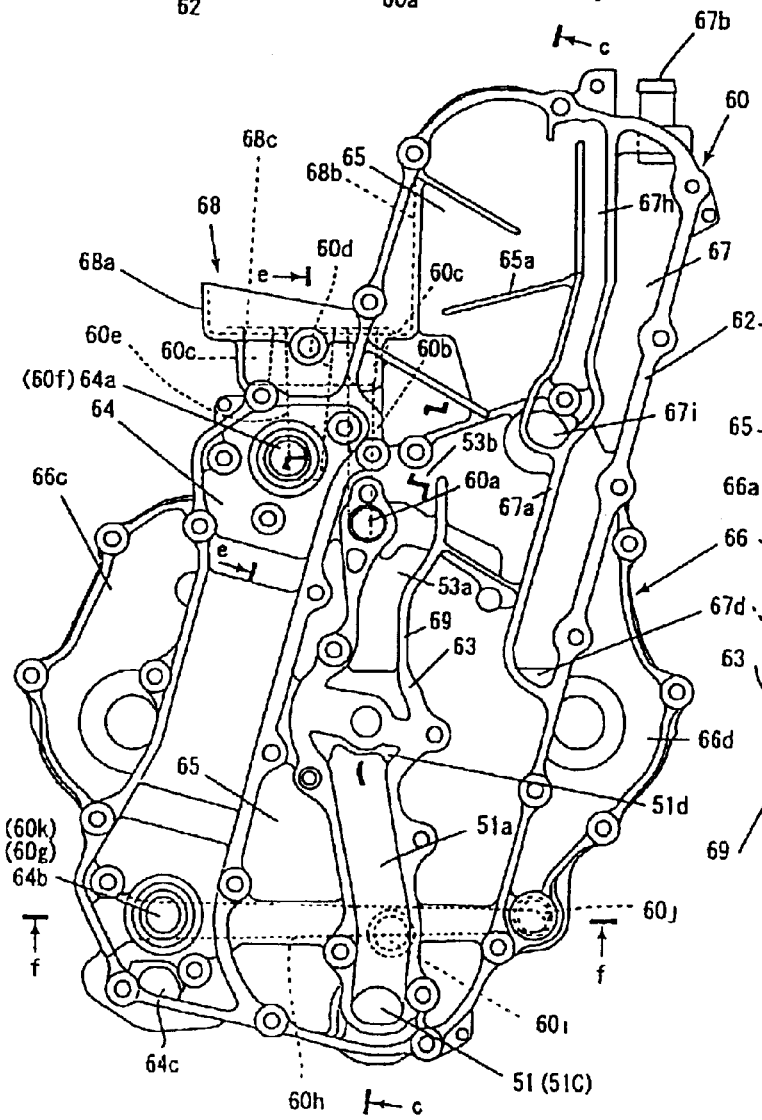
FIG. 14(b)
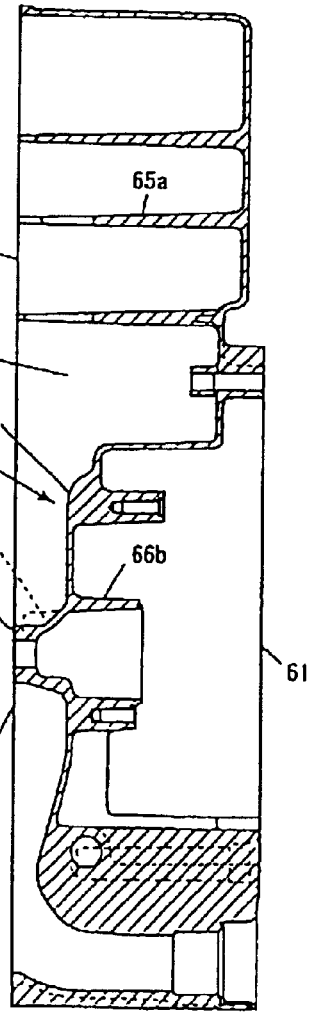
FIG. 14(c)

DRY SUMP ENGINE FOR A SMALL PLANING BOAT

CROSS-REFERENCES TO RELATED APPLICATIONS

This nonprovisional application claims priority under 35 U.S.C. § 119(a) on Patent Application No. 2001-219323 filed in Japan on Jul. 19, 2001, the entirety of which is herein incorporated by reference.

BACKGROUND OF THE INVENTION

1. Field of the Invention

The present invention relates to a dry-sump engine, and more particularly for a planing boat or watercraft, e.g., a small personal watercraft.

2. Description of the Background Art

Heretofore, two-cycle engines have generally been used as power sources for small planing boats or watercraft. However, the use of a four-cycle engine has been examined recently for accommodating low-pollution and noise reduction requirements.

In a small, planing boat, a compact engine is required because the engine is stored in a small space defined by a hull and a deck arranged in a substantially sealed state. However, the four-cycle engine tends to be large and cumbersome because a cylinder head having a dynamic valve system is often disposed in the upper part of the engine, and an oil pan is disposed in the lower part of the engine, see, e.g., Japanese Patent Publication No. 2754371.

SUMMARY OF THE INVENTION

The present invention overcomes the shortcomings associated with the background art and achieves other advantages not realized by the background art.

An object of the present invention is to provide a dry-sump engine for a planing boat or watercraft that reduces the overall height of the engine.

One or more of these and other objects are accomplished by a dry-sump engine for a planing boat having a jet propulsion pump, the dry sump engine comprising a crankshaft extending along an axial centerline of the engine; an upper case and a lower case of the dry-sump engine; at least one fastening bolt securing the upper case and the lower case of the engine along a parting plane; an oil pan, the lower case including a mounting face for joining a joint surface of an oil pan and being provided in a position below the parting plane, wherein the fastening bolt is positioned higher than the oil pan with respect to the parting plane and the mounting face surrounds the at least one fastening bolt when viewed with respect to a bottom portion of the lower case and the engine centerline.

One or more of these and other objects are further accomplished by, in combination, a dry-sump engine and a planing boat, the engine driving a jet propulsion pump for the planning boat and being arranged in a vessel body of the boat and surrounded by a hull and a deck, the engine comprising a crankshaft extending along a length of the vessel body and in parallel with a centerline of the engine; an upper case and a lower case of the dry-sump engine; at least one fastening bolt securing the upper case and the lower case of the engine along a parting plane; an oil pan, the lower case including a mounting face for joining a joint surface of an oil pan and being provided in a position below the parting plane, wherein the fastening bolt is positioned higher than the oil pan with respect to the parting plane and the mounting face surrounds the at least one fastening bolt when viewed with respect to a bottom portion of the lower case and the engine centerline.

In a dry-sump engine for a small planing boat according to the present invention, since an engine for driving a jet propulsion pump is arranged in the vessel body surrounded by a hull and a deck so that the crankshaft thereof extends along the length of the vessel body, and a mounting face for an oil pan is provided in the outside vicinity of a fastening bolt for fastening an upper case and a lower case of the engine that support the crankshaft when viewed from the bottom, the overall height of the engine may be reduced.

If the mounting face for the oil pan is provided inside the fastening bolt when viewed from the bottom, the capacity of the oil pan is reduced. If the mounting face is provided outside the fastening bolt at a distance therefrom, the width of the oil pan increases, and thus it can hardly be fitted to the configuration of the vessel. Further, if the mounting face for the oil pan is overlapping the fastening bolt when viewed from the bottom, the overall height of the engine increases correspondingly.

Since the mounting face for the oil pan may be provided in the outside vicinity of the fastening bolt when viewed from the bottom in an embodiment of the present invention, the overall height of the engine may be reduced. In addition, the oil pan may be provided while securing an appropriate capacity, while being adapted to the bottom of the vessel body, and by securing an appropriate clearance with respect to the vessel body.

Since the engine for driving a jet propulsion pump may be disposed in the vessel body surrounded by the hull and the deck, the engine is provided with an oil pan below the crankshaft, and a strainer is provided in the vicinity of the engaging surface between the oil pan and the engine along the engaging surface. The overall height of the engine may be reduced while securing the area of the strainer.

Since the strainer may be provided integrally with the oil pan, the strainer can be mounted simultaneously with the oil pan. Since the portion in the vicinity of the bottom of the oil pan and an oil pump provided at the end of the crankshaft may be brought into communication with each other with a joint pipe in the dry-sump engine, oil filtered through the strainer is directly guided into the oil pump. Therefore, the entry of foreign matter and contaminates into the oil pump is prevented, thereby improving durability of the oil pump.

Since the oil pump is provided at the end of the crankshaft, and an oil exit in communication with the oil-pump is provided on the oil pan at the end in the axial direction of the crankshaft, the overall height of the engine can be reliably reduced in comparison with the case where the oil exit is provided for example at the bottom of the oil pan.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus are not limitative of the present invention, and wherein:

FIG. 9(*b*) is a left side view of the engine block of FIG. 9(*a*);

FIG. 11(*b*) is a cross sectional view taken along the line b—b in FIG. 11(*a*);

FIG. 12(*b*) is a cross-sectional view taken along the line b—b in the FIG. 12(*a*);

FIG. 13(*b*) is a bottom view of the strainer of FIG. 13(*a*);

FIG. 13(*c*) is a cross-sectional view taken along the line c—c in FIG. 13(*a*);

FIG. 14(*a*) is a plan view of a tank body according to the present invention;

FIG. 14(*b*) is a front view of the tank body of FIG. 14(*a*);

FIG. 14(*c*) is a cross sectional view taken along the line c—c in FIG. 14(*b*);

FIG. 14(*d*) is a cross sectional view taken along the line d—d in FIG. 14(*a*);

FIG. 16(*f*) is a cross sectional view taken along the line f—f in FIG. 14(*b*);

FIG. 17(*b*) is a cross sectional view taken along the line b—b in FIG. 17(*a*);

FIG. 17(*c*) is a cross sectional view taken along the line c—c in FIG. 17(*a*);

FIG. 17(*d*) is a cross sectional view taken along the line d—d in FIG. 17(*a*);

FIG. 18(*b*) is a side view showing the cover of FIG. 18(*a*) as viewed in the direction shown by the arrow b in FIG. 18(*a*);

FIG. 18(*c*) is a cross sectional view taken along the line c—c in FIG. 18(*a*);

FIG. 21(*b*) is a cross sectional view taken along the line b—b in FIG. 21(*a*);

FIG. 23(*b*) is a side view of the engine and oil tank shown in FIG. 23(*a*);

FIG. 24(*b*) is a side view of FIG. 24(*a*).

DETAILED DESCRIPTION OF THE PREFERRED EMBODIMENTS

Figure 1:
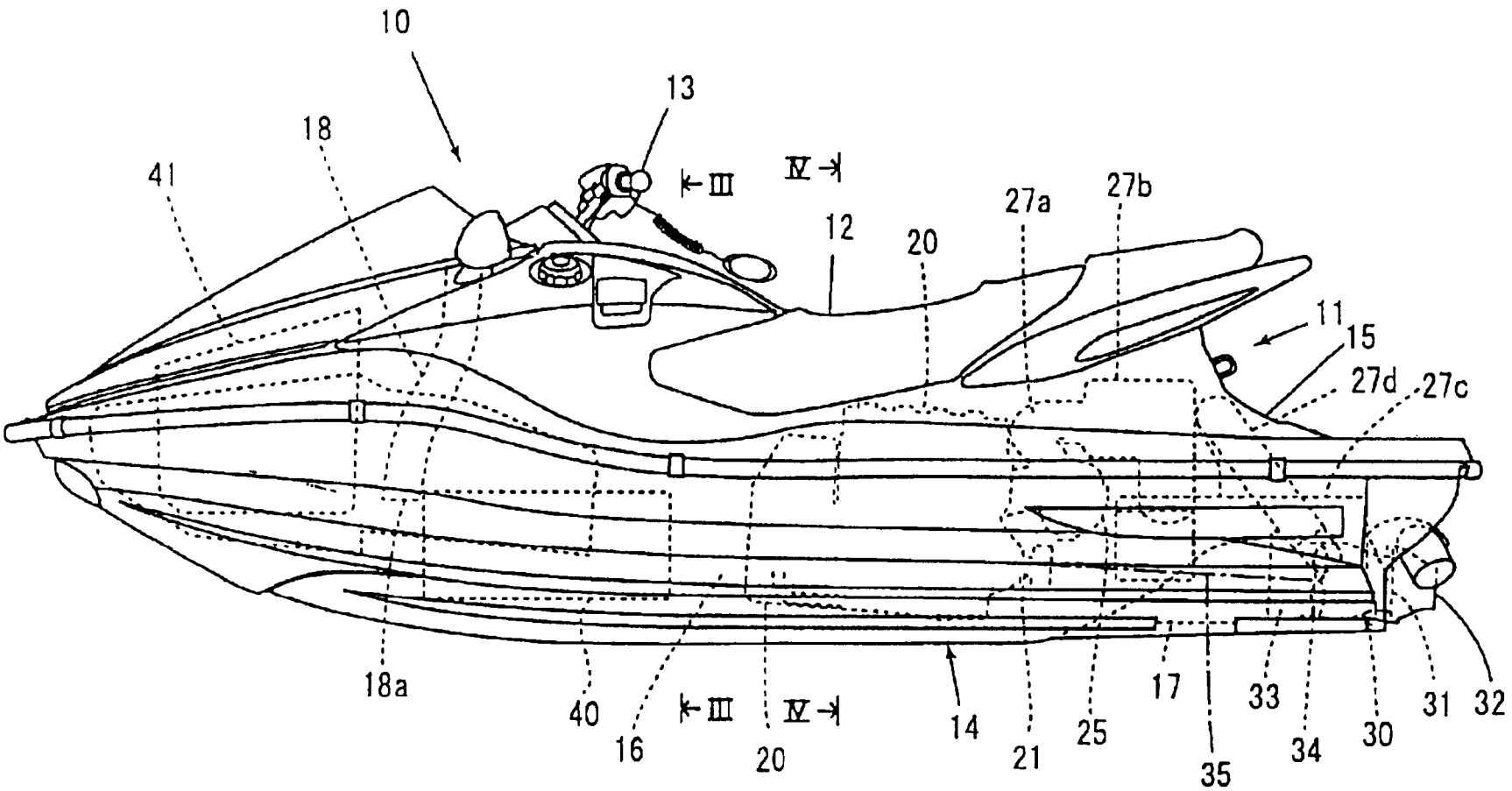
FIG. 1 is a side view showing an exemplary planing watercraft including a dry-sump engine according to an embodiment of the present invention.
Figure 2:
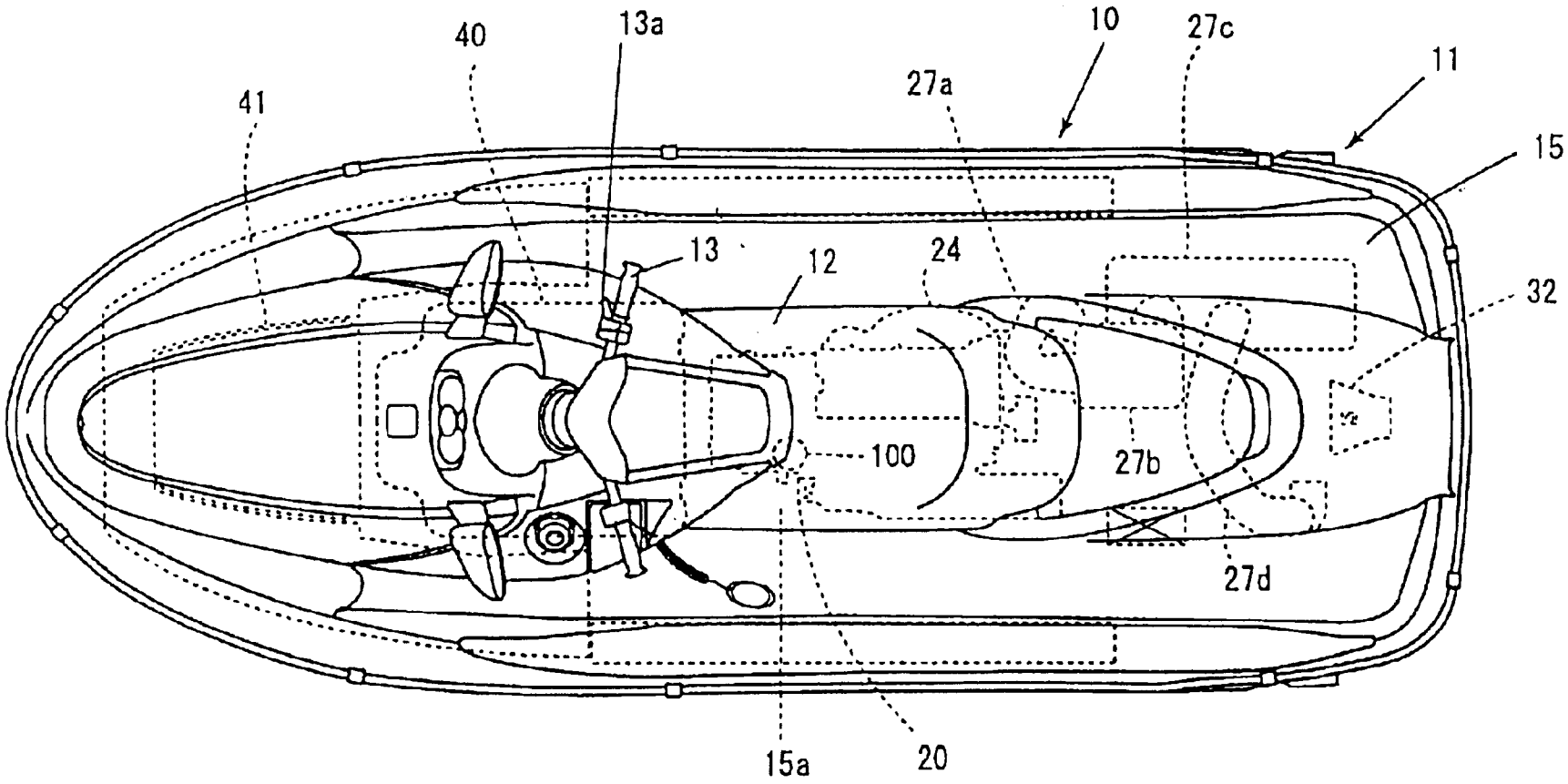
FIG. 2 is a plan view of the watercraft shown in FIG. 1.
Figure 3:
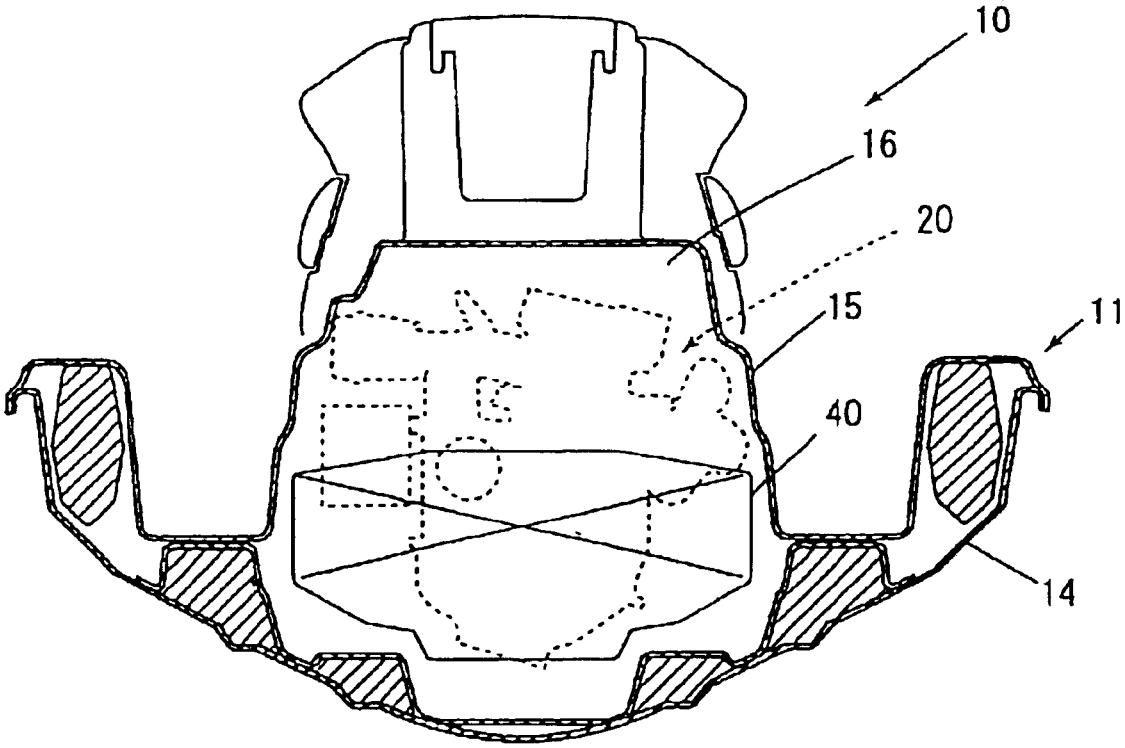
FIG. 3 is a partially enlarged, cross sectional view taken along the line III—III in FIG. 1.
Figure 4:
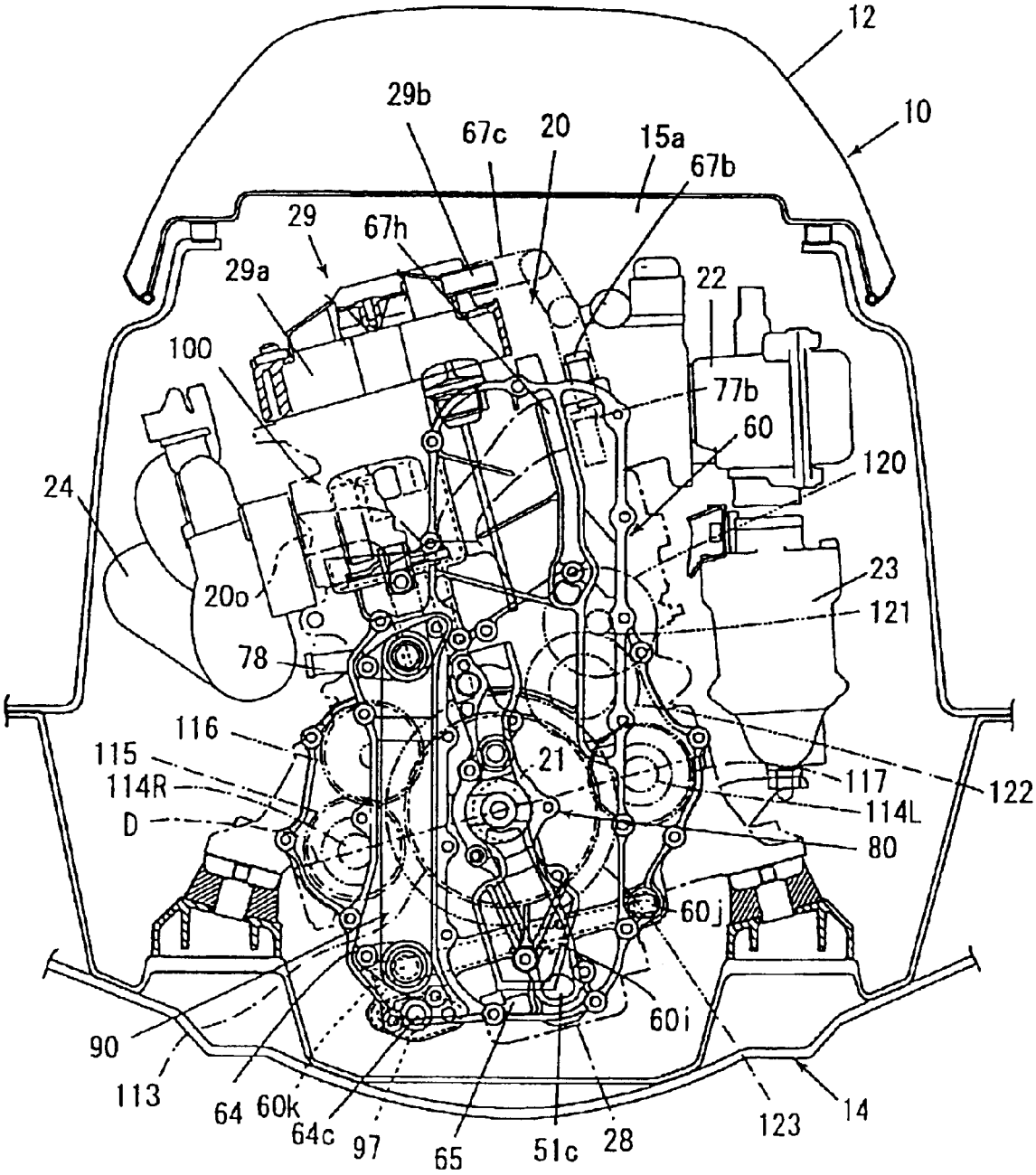
FIG. 4 is a partially enlarged, cross sectional view taken along the line IV—IV in FIG. 1.
Figure 5:
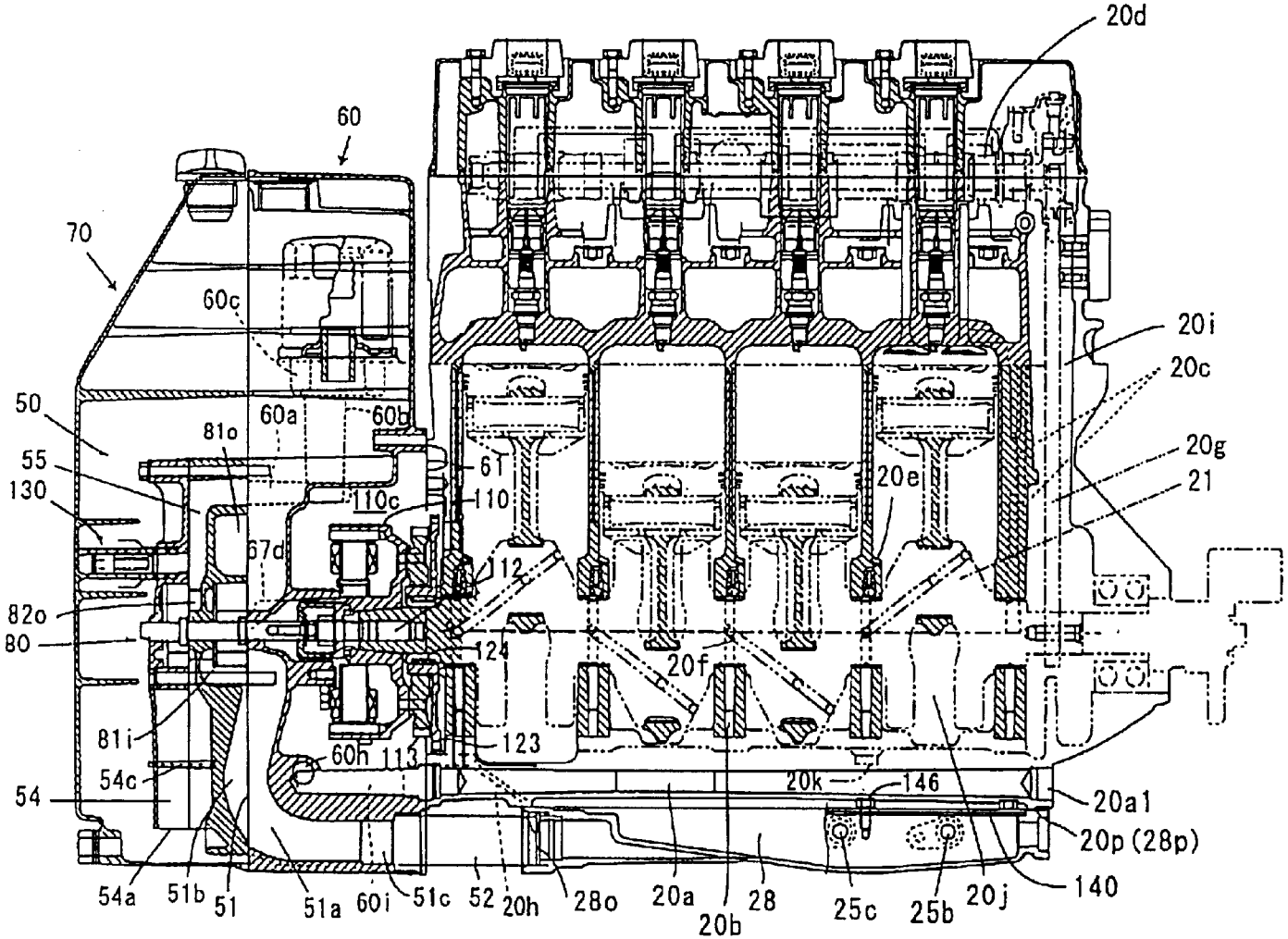
FIG. 5 is a right side view of the engine according to an embodiment of the present invention.
Figure 6:
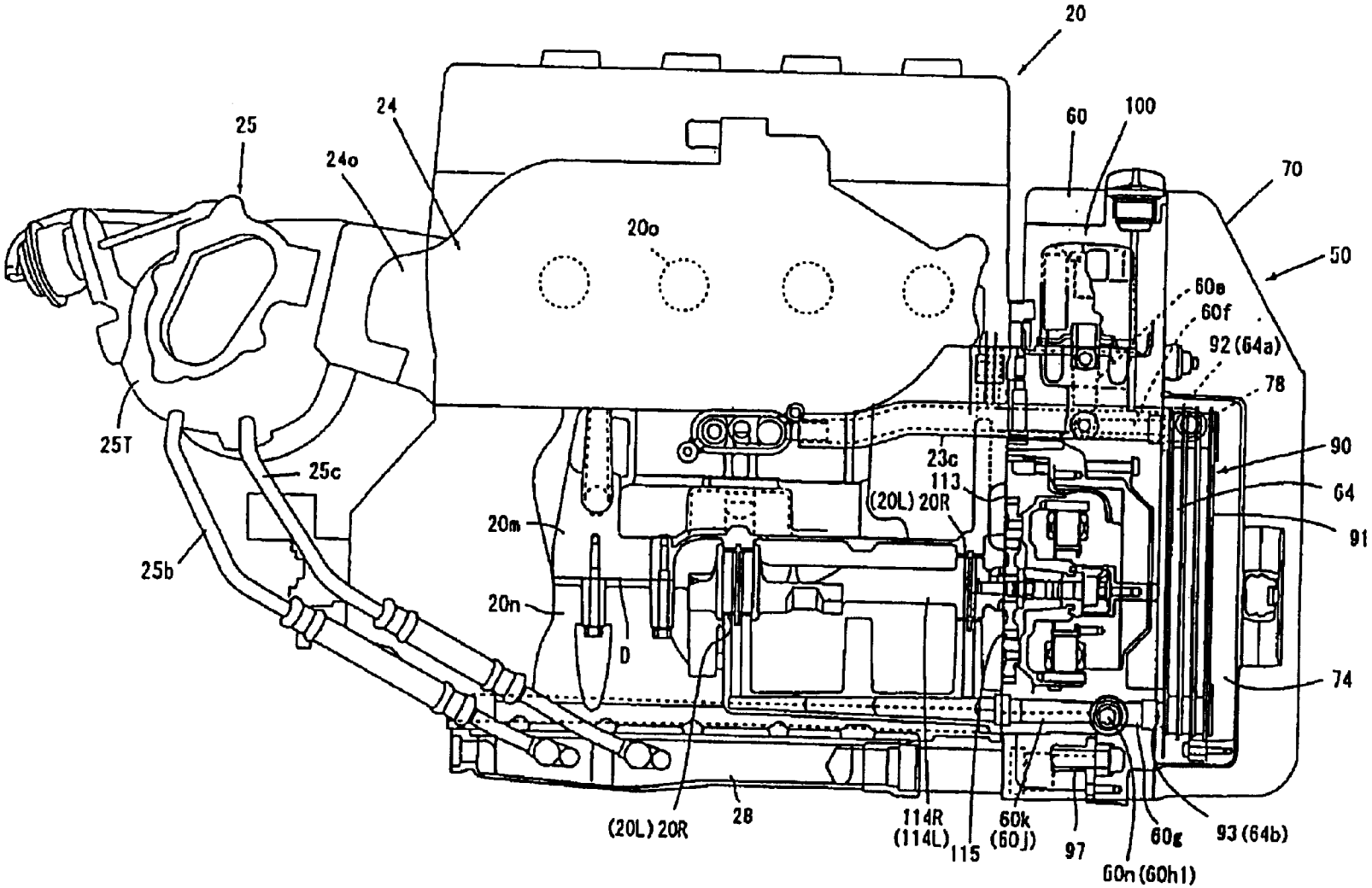
FIG. 6 is a left side view of the engine according to an embodiment of the present invention.
Figure 7:
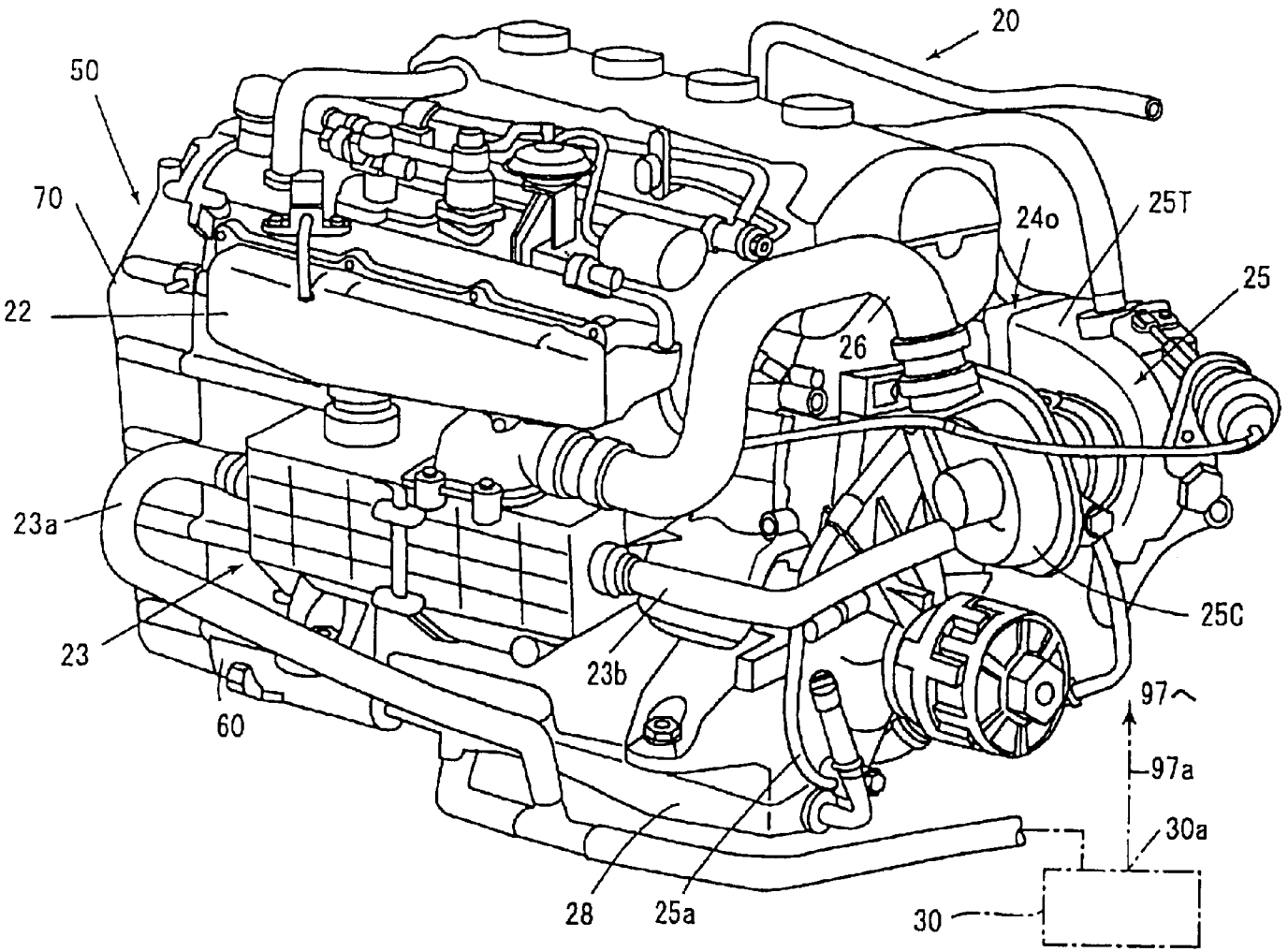
FIG. 7 is a perspective view of the engine according to an embodiment of the present invention.
Figure 8:
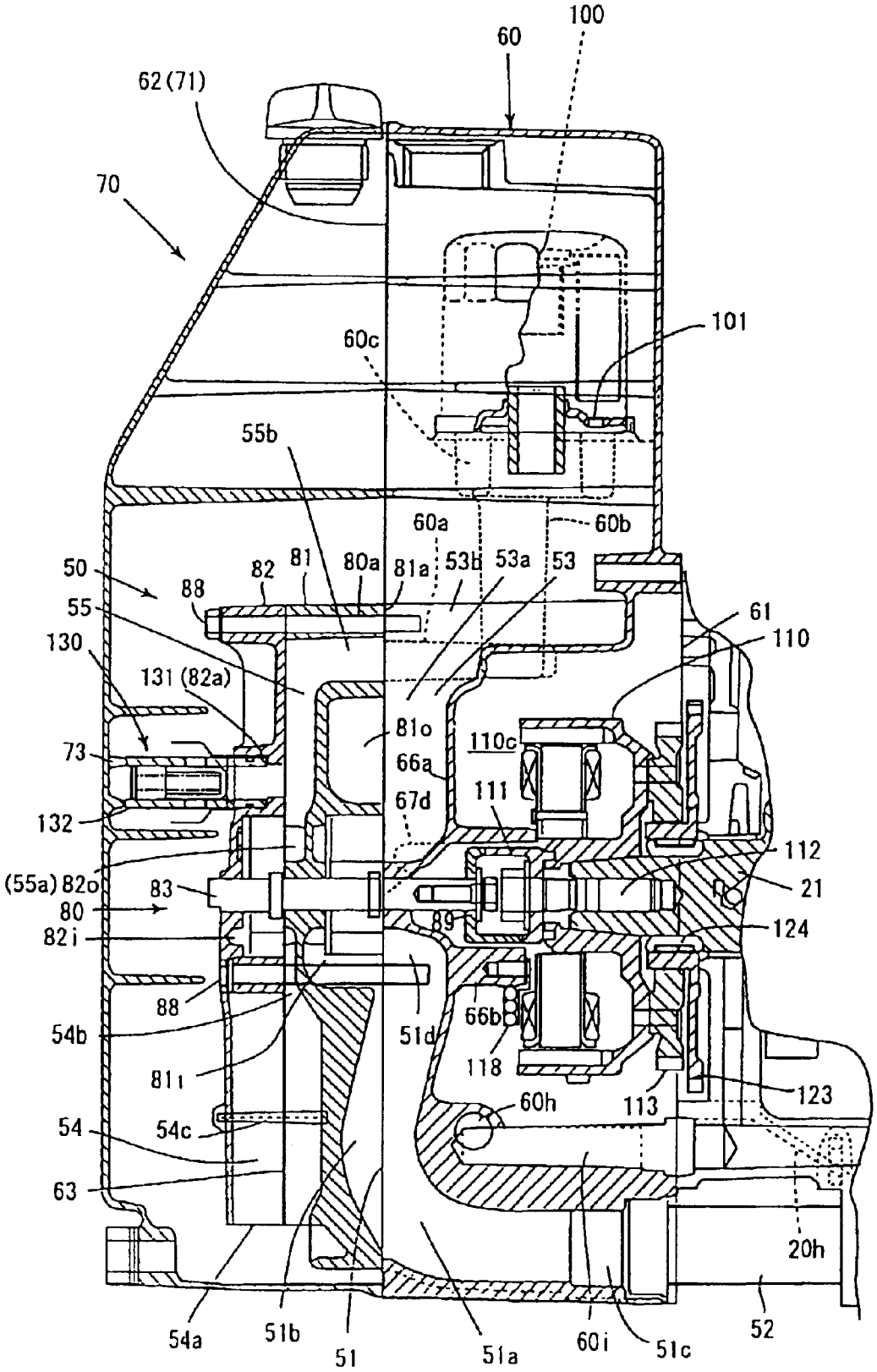
FIG. 8 is a partially enlarged view of FIG. 5.
Figure 9A:
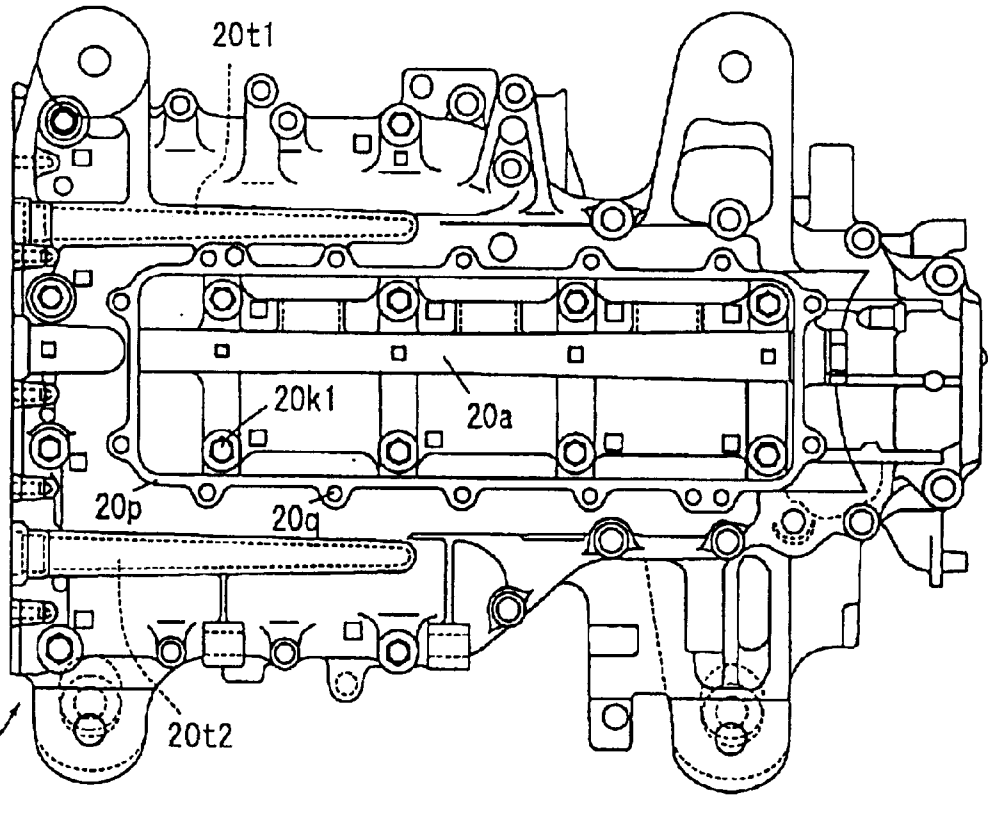
FIG. 9(*a*) is a bottom view of an engine block according to an embodiment of the present invention.
Figure 9B:
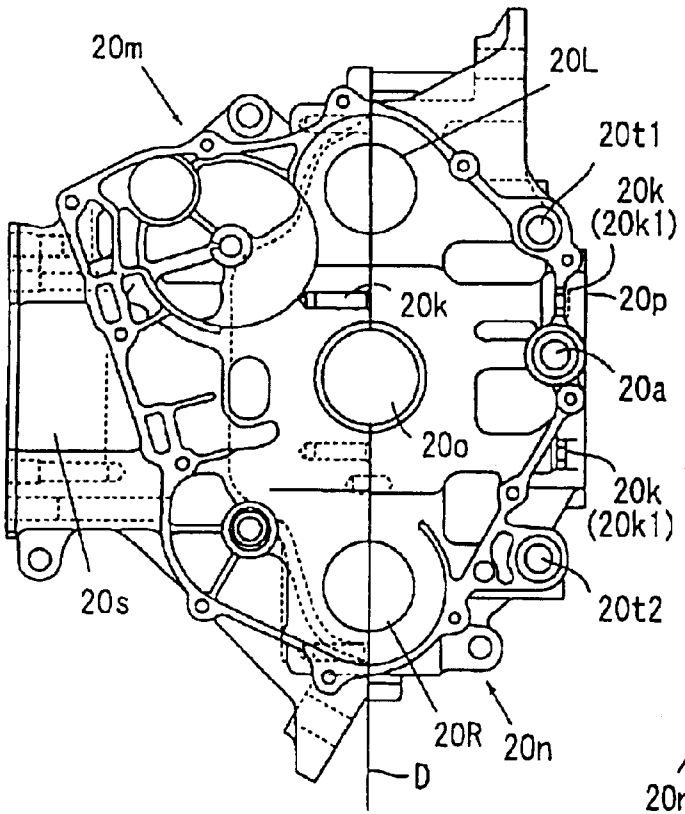
Figure 10:
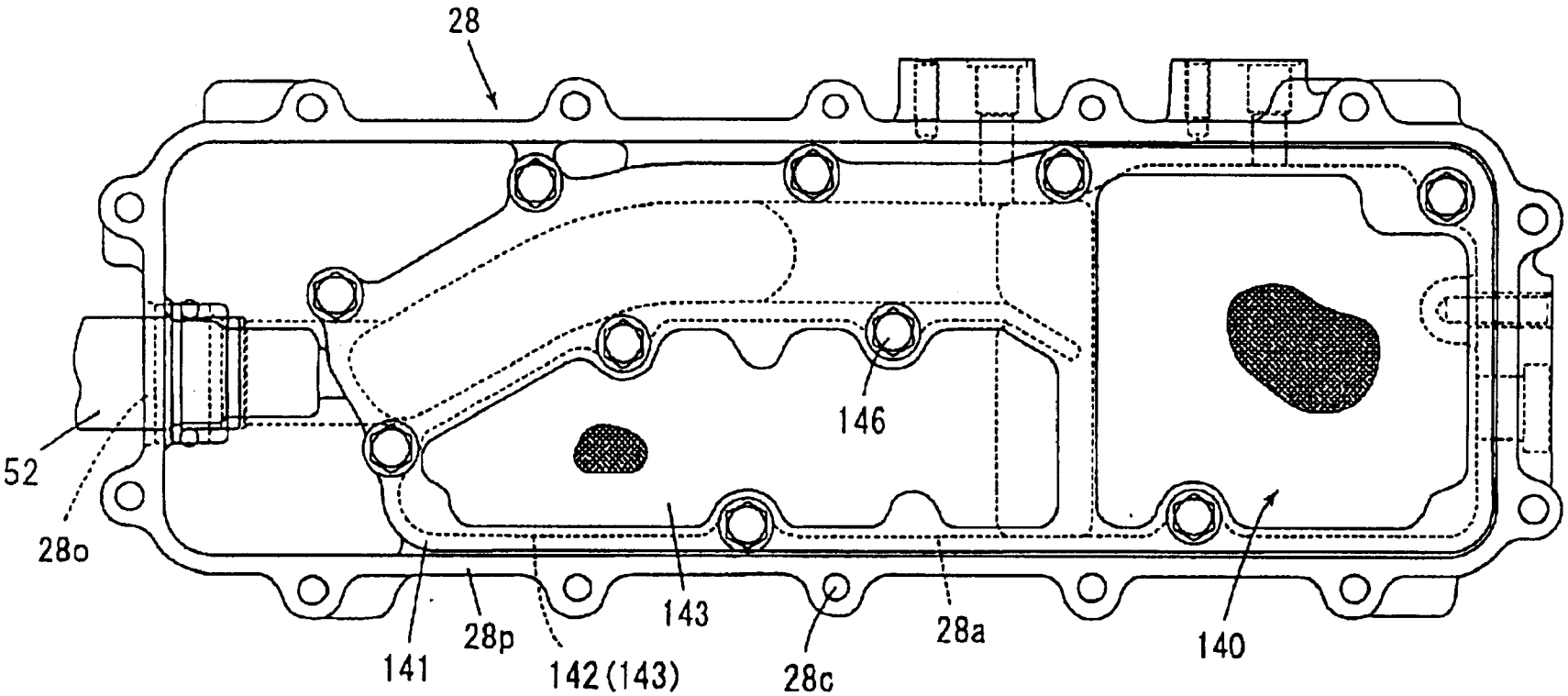
FIG. 10 is a plan view of an oil pan having a strainer attached thereon according to an embodiment of the present invention.
Figure 11A:
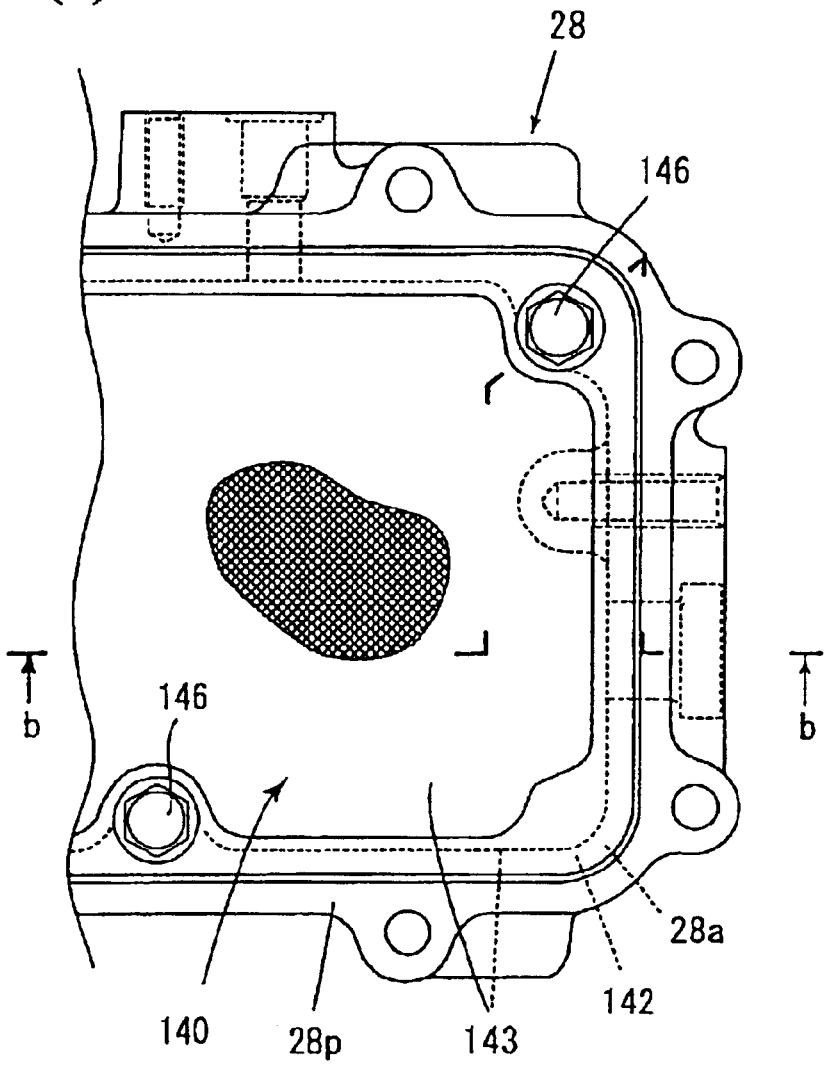
FIG. 11(*a*) is a partially enlarged view of FIG. 10.
Figure 11B:
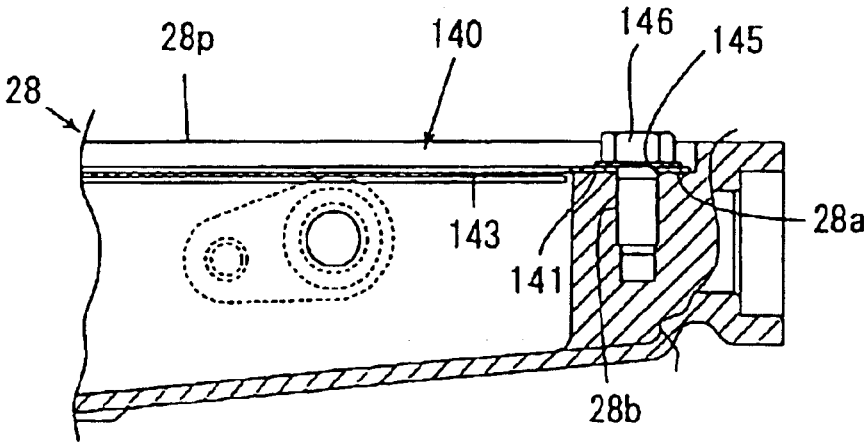

The present invention will hereinafter be described with reference an embodiment(s) of the present invention shown in the accompanying drawings. FIG. 1 is a side view showing an exemplary planing watercraft including a dry-sump engine according to an embodiment of the present invention. FIG. 2 is a plan view of the watercraft shown in FIG. 2. FIG. 3 is a partially enlarged, cross sectional view taken along the line III—III in FIG. 1. FIG. 4 is a partially enlarged, cross sectional view taken along the line IV—IV in FIG. 1. FIG. 5 is a right side view of the engine according to an embodiment of the present invention. FIG. 6 is a left side view of the engine according to an embodiment of the present invention. FIG. 7 is a perspective view of the engine according to an embodiment of the present invention. FIG. 8 is a partially enlarged view of FIG. 5. FIG. 9(*a*) is a bottom view of an engine block according to an embodiment of the present invention. FIG. 9(*b*) is a left side view of the engine block of FIG. 9(*a*). FIG. 10 is a plan view of an oil pan having a strainer attached thereon according to an embodiment of the present invention. FIG. 11 (*a*) is a partially enlarged view of FIG. 10. FIG. 11(*b*) is a cross sectional view taken along the line b—b in FIG. 11(*a*).

Figure 12A:
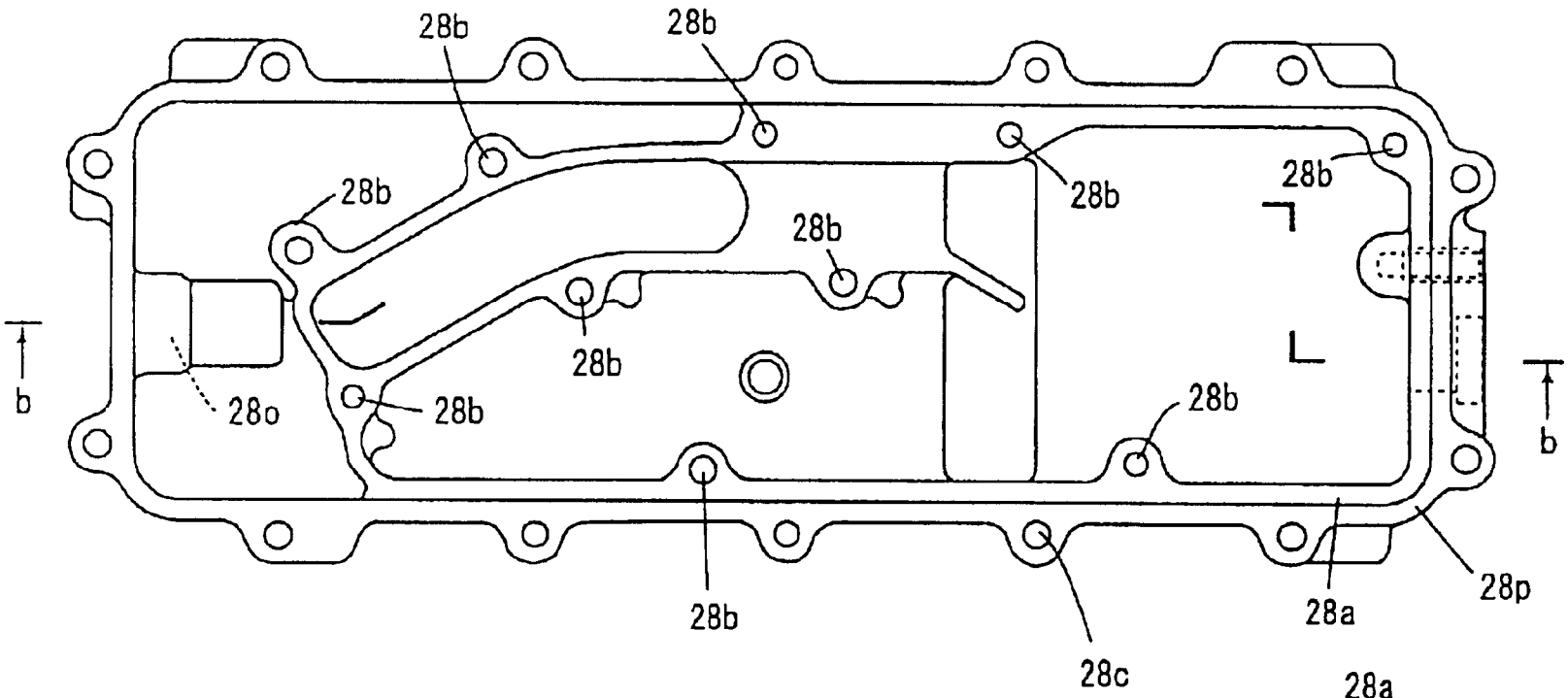
FIG. 12(*a*) is a plan view of an oil pan according to the present invention.
Figure 12B:
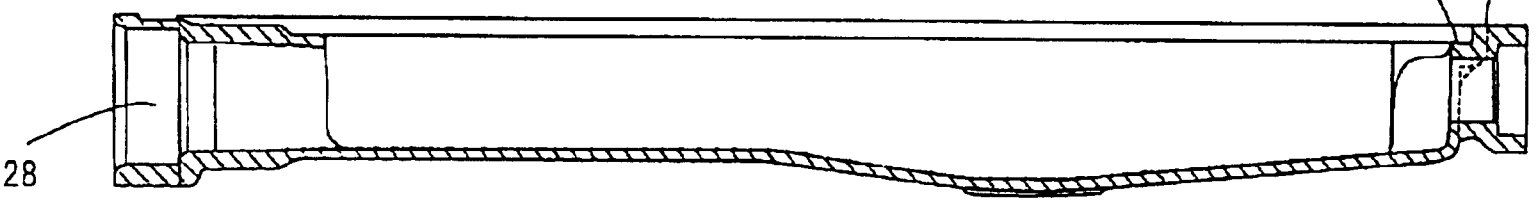
Figures 13A, 13B, 13C:
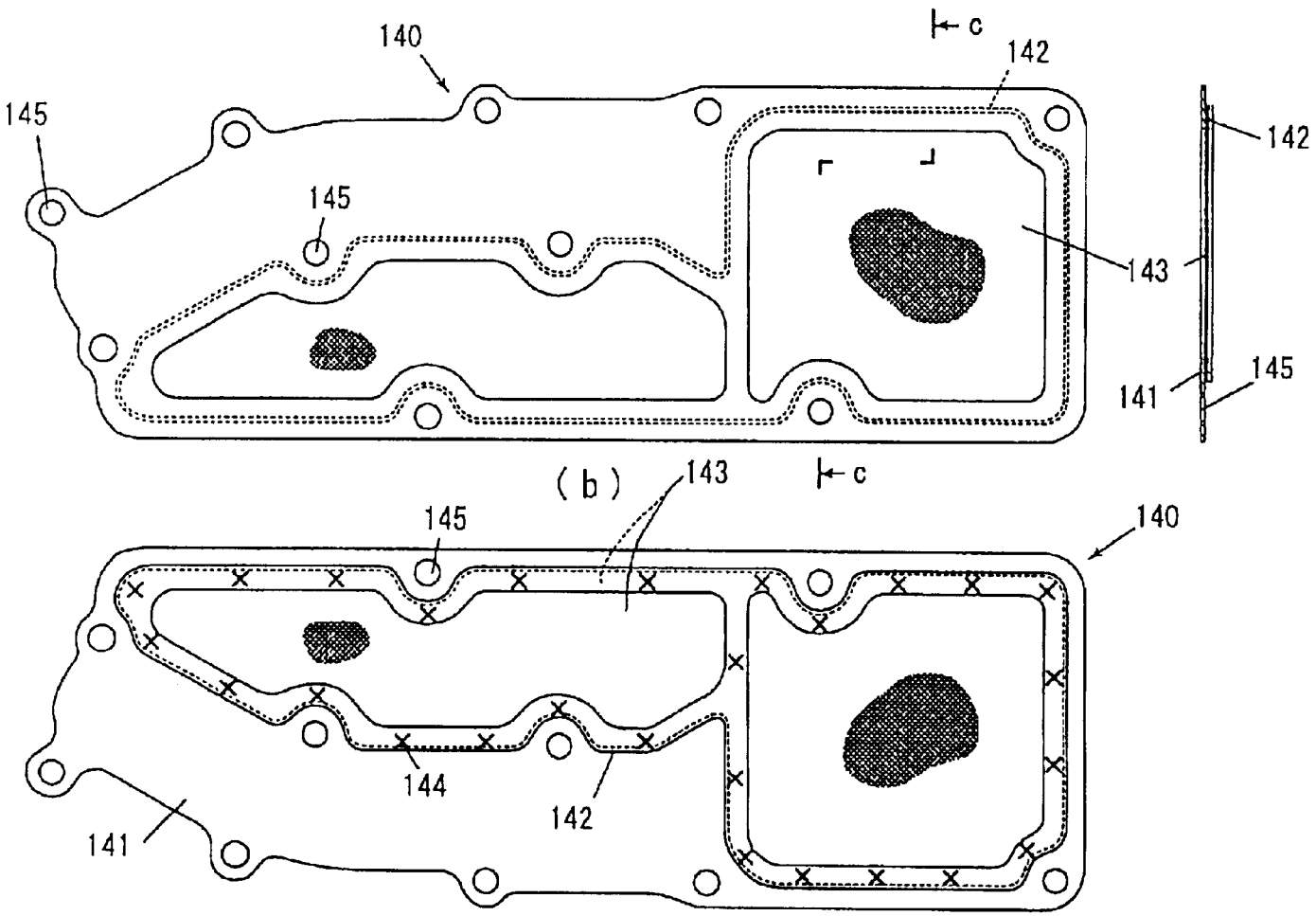
FIG. 13(*a*) is a plan view of a strainer according to the present invention.
Figure 15:
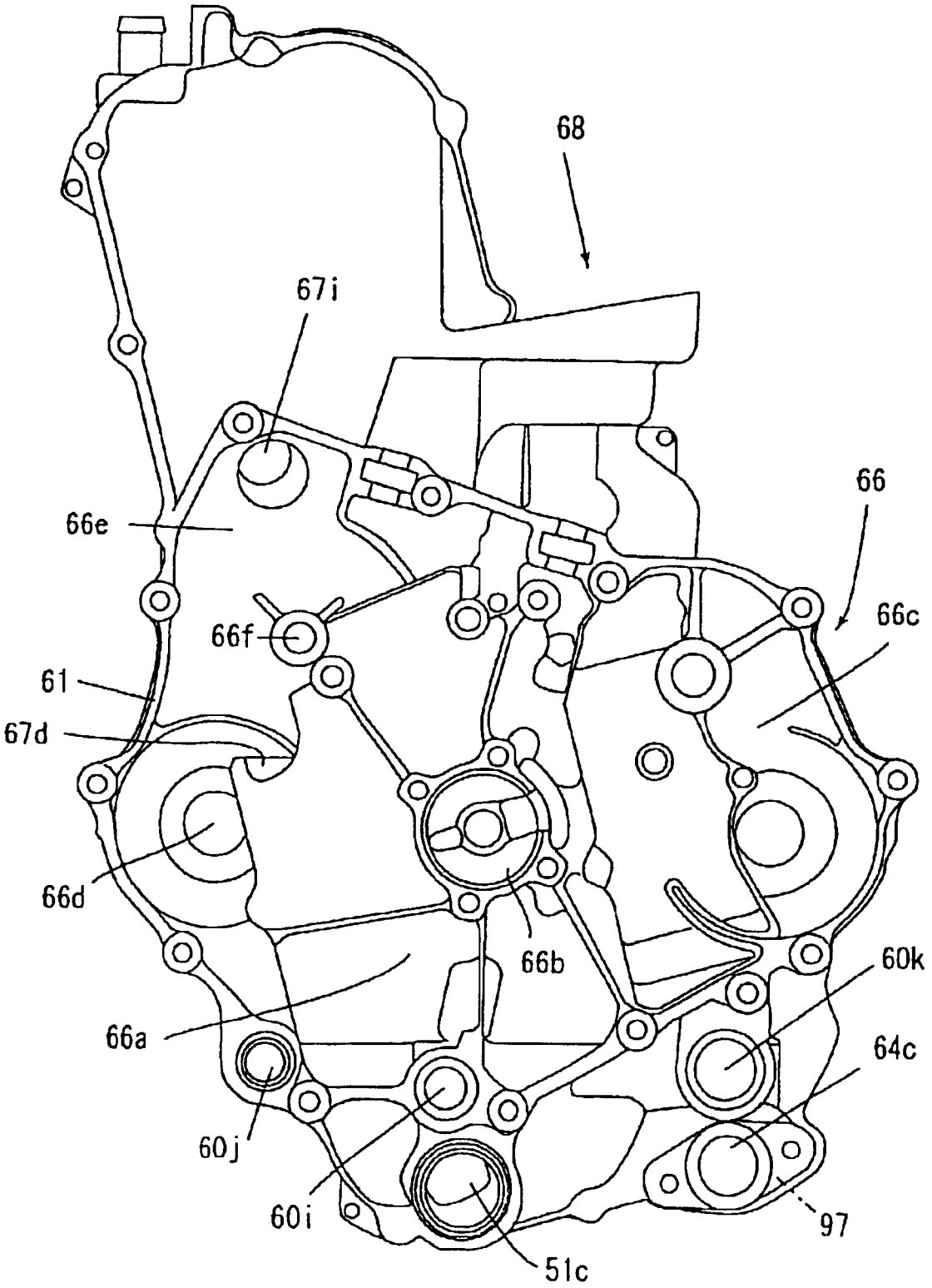
FIG. 15 is a rear view of the tank body according to the present invention.
Figure 16E:
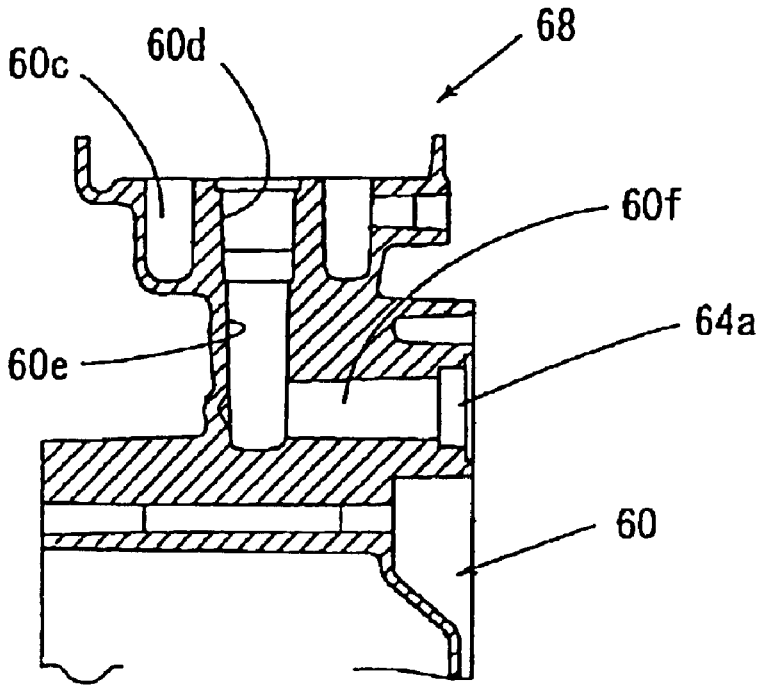
FIG. 16(*e*) is a cross sectional view taken along the line c—c of FIG. 14(*b*)
Figure 16F:
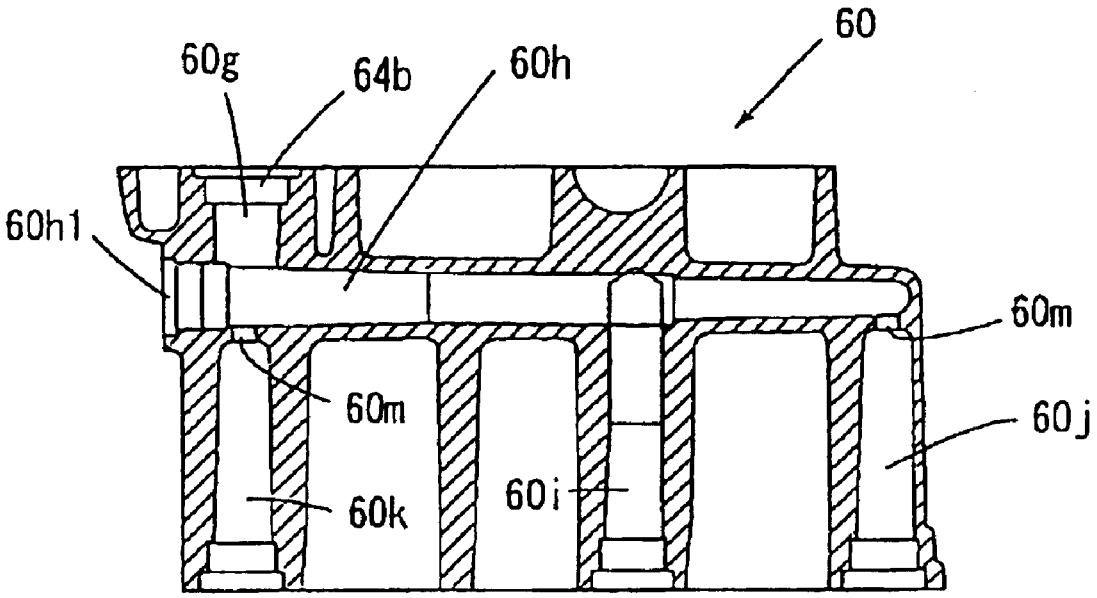
Figure 17B:
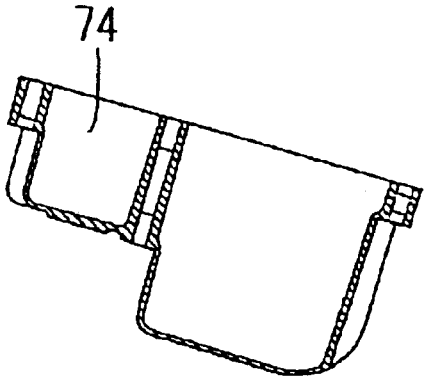
FIG. 17(*a*) is a front view of a cover according to the present invention.
Figure 17D:
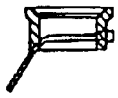
Figure 17A:
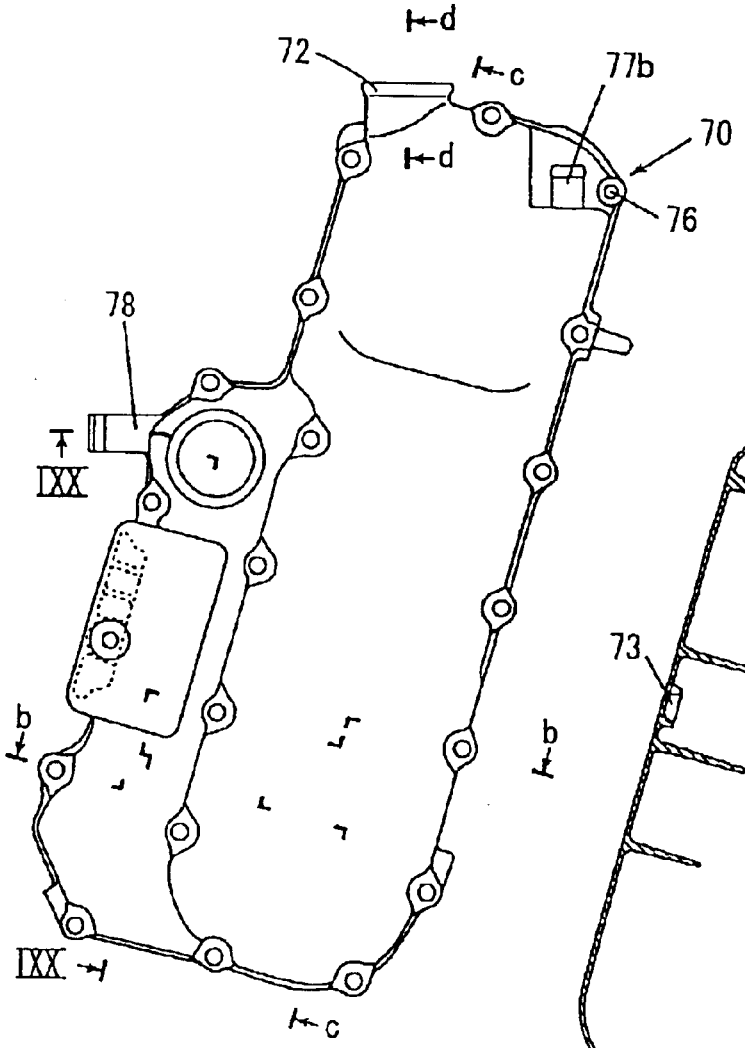
Figure 17C:
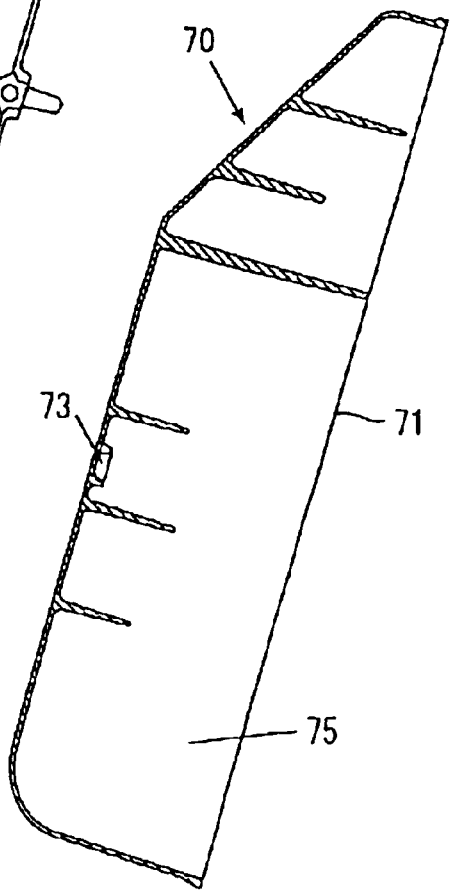

FIG. 12(*a*) is a plan view of an oil pan according to the present invention. FIG. 12(*b*) is a cross-sectional view taken along the line b—b in the FIG. 12(*a*). FIG. 13(*a*) is a plan view of a strainer according to the present invention. FIG. 13(*b*) is a bottom view of the strainer of FIG. 13(*a*). FIG. 13(*c*) is a cross-sectional view taken along the line c—c in FIG. 13(*a*). FIG. 14(*a*) is a plan view of a tank body according to the present invention. FIG. 14(*b*) is a front view of the tank body of FIG. 14(*a*). FIG. 14(*c*) is a cross sectional view taken along the line c—c in FIG. 14(*b*). FIG. 14(*d*) is a cross sectional view taken along the line d—d in FIG. 14(*a*). FIG. 15 is a rear view of the tank body according to the present invention. FIG. 16(*e*) is a cross sectional view taken along the line e—e of FIG. 14(*b*). FIG. 16(*f*) is a cross sectional view taken along the line f—f in FIG. 14(*b*). FIG. 17(*a*) is a front view of a cover according to the present invention. FIG. 17(*b*) is a cross sectional view taken along the line b—b in FIG. 17(*a*). FIG. 17(*c*) is a cross sectional view taken along the line c—c in FIG. 17(*a*). FIG. 17(*d*) is a cross sectional view taken along the line d—d in FIG.

Figure 18B:
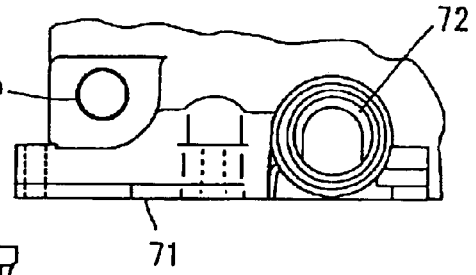
FIG. 18(*a*) is a rear view of a cover according to the present invention.
Figure 18A:
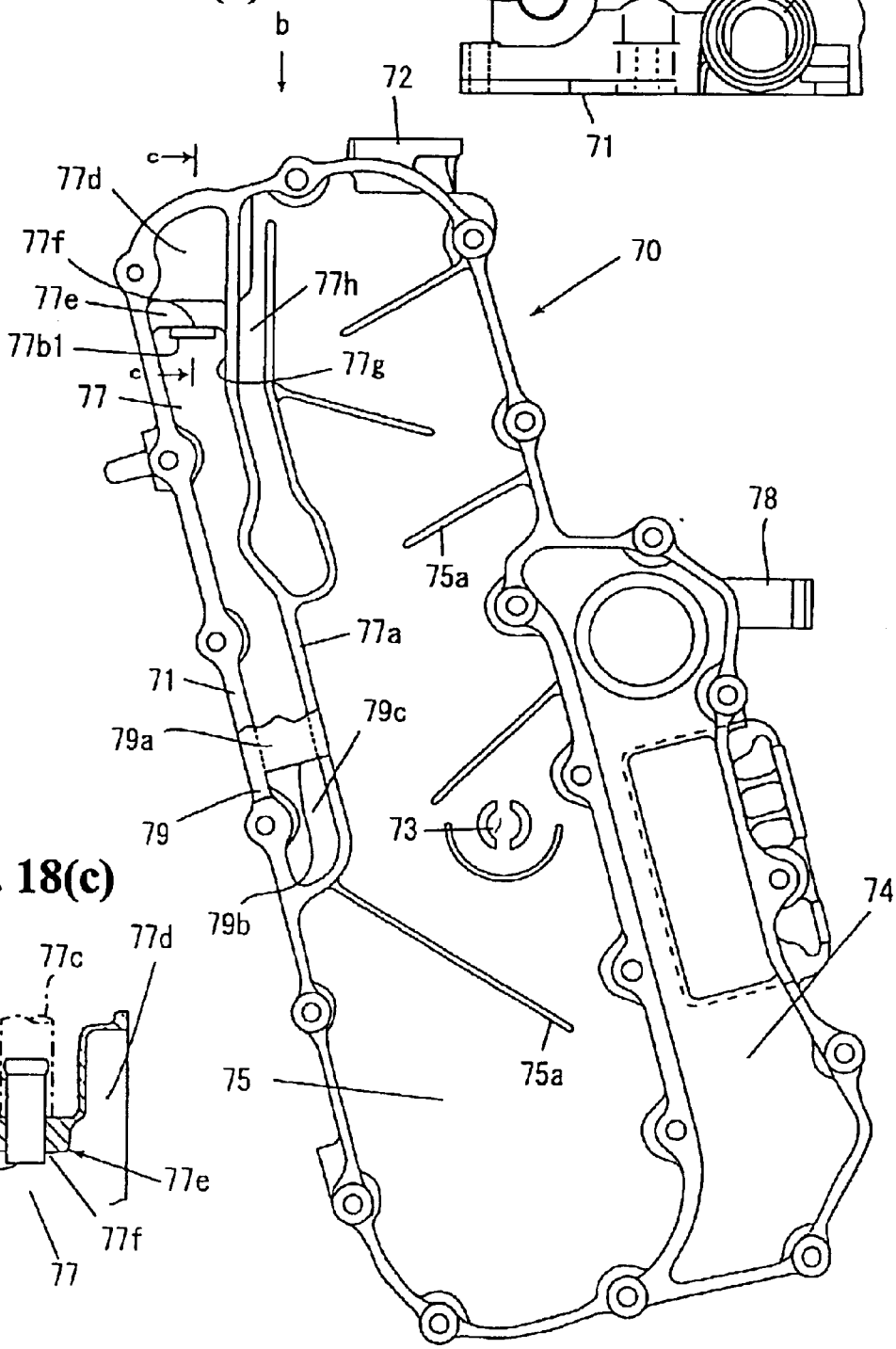
Figure 18C:
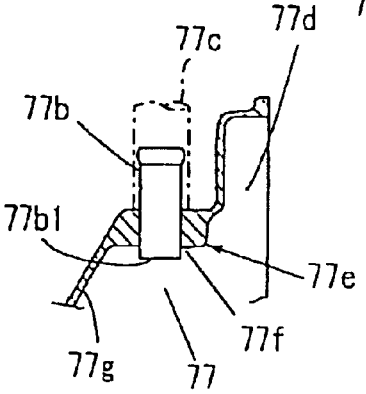
Figure 19:
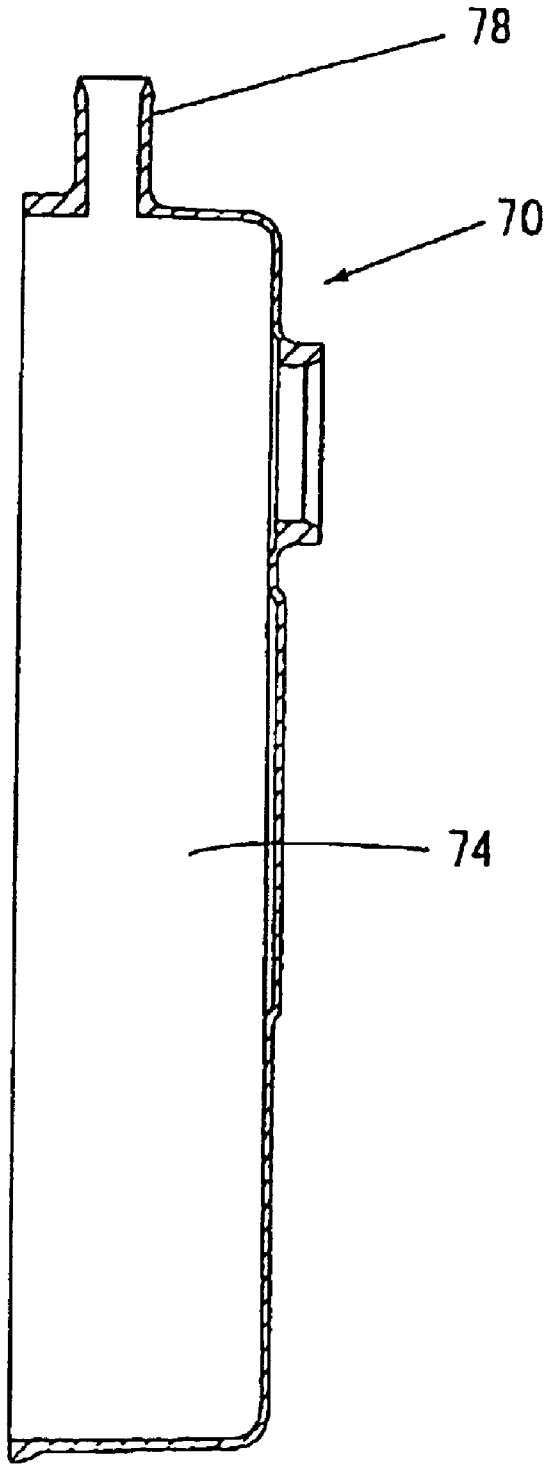
FIG. 19 is a cross sectional view taken along the line IXX—IXX in FIG. 17(*a*)
Figure 20:
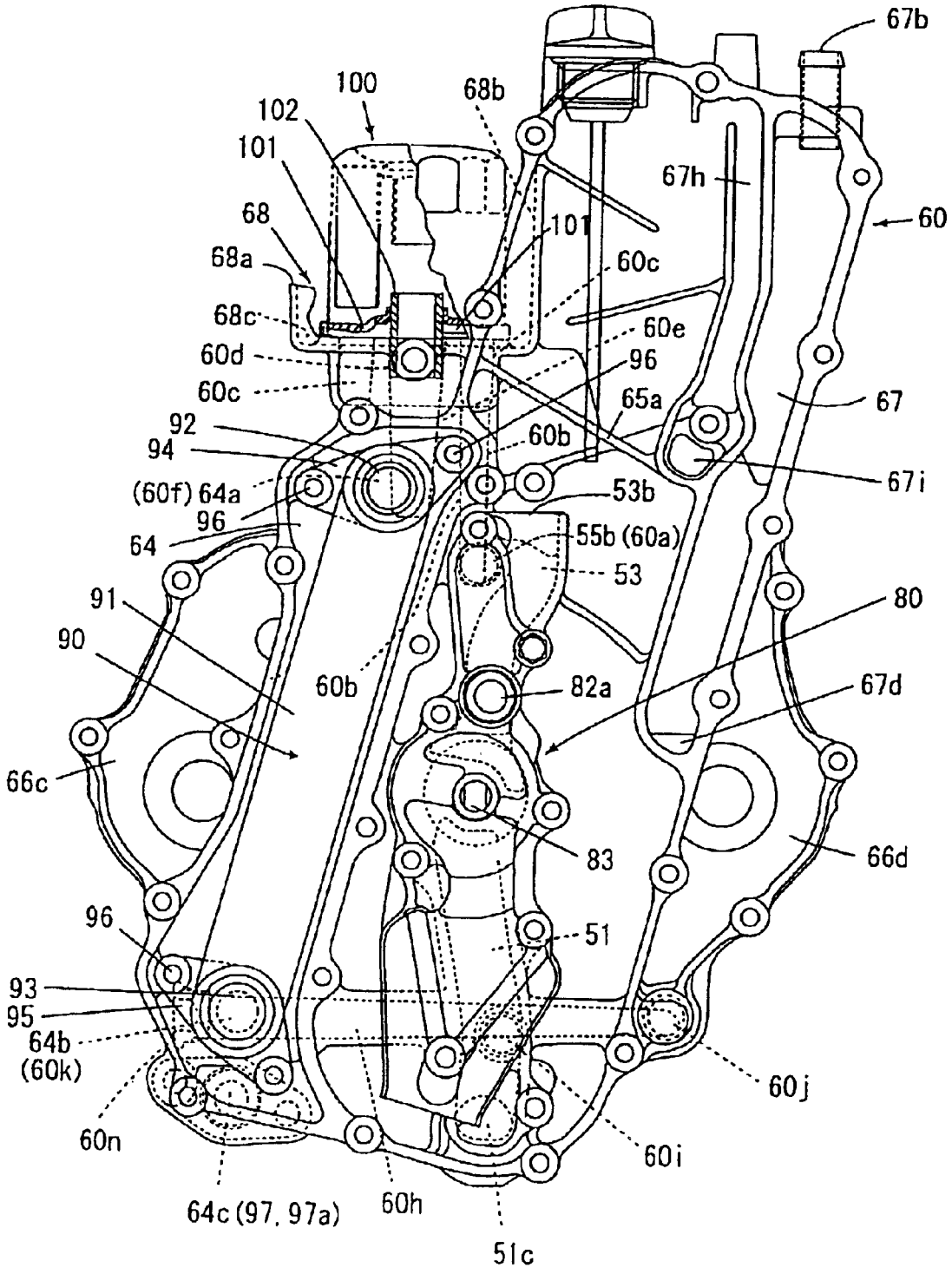
FIG. 20 is a partially enlarged view of FIG. 4.
Figure 21A:
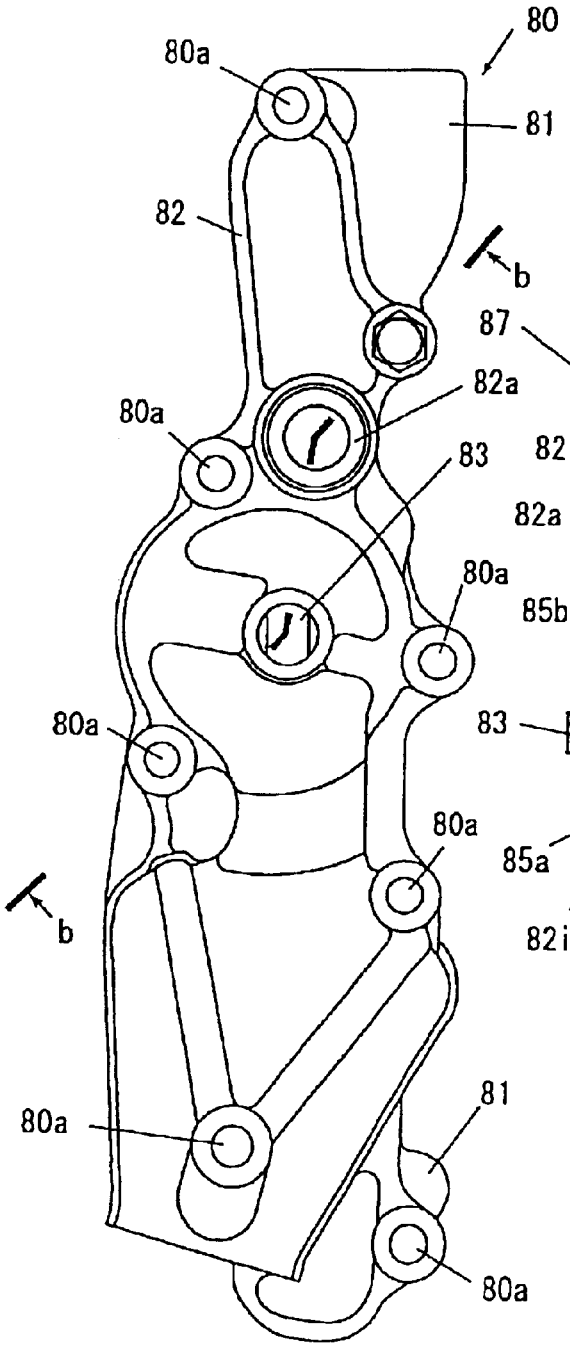
FIG. 21(*a*) is a front view of an oil pump according to the present invention.
Figure 21B:
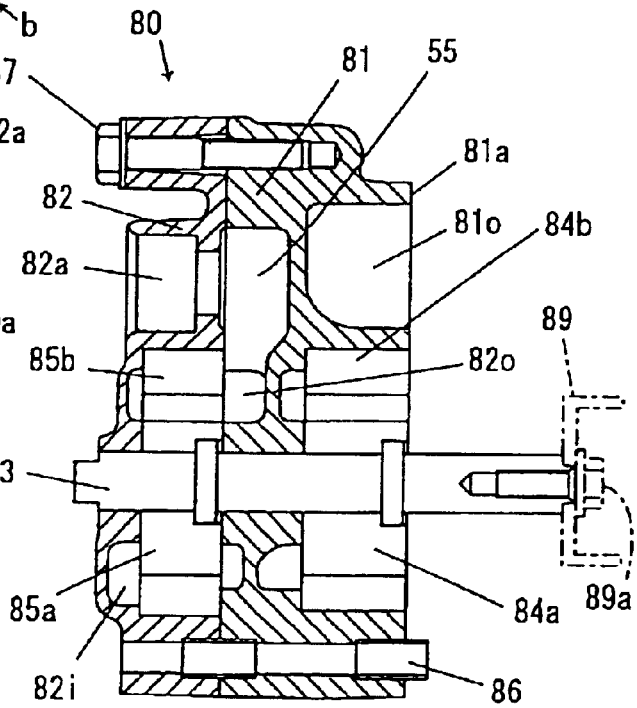
Figure 22:
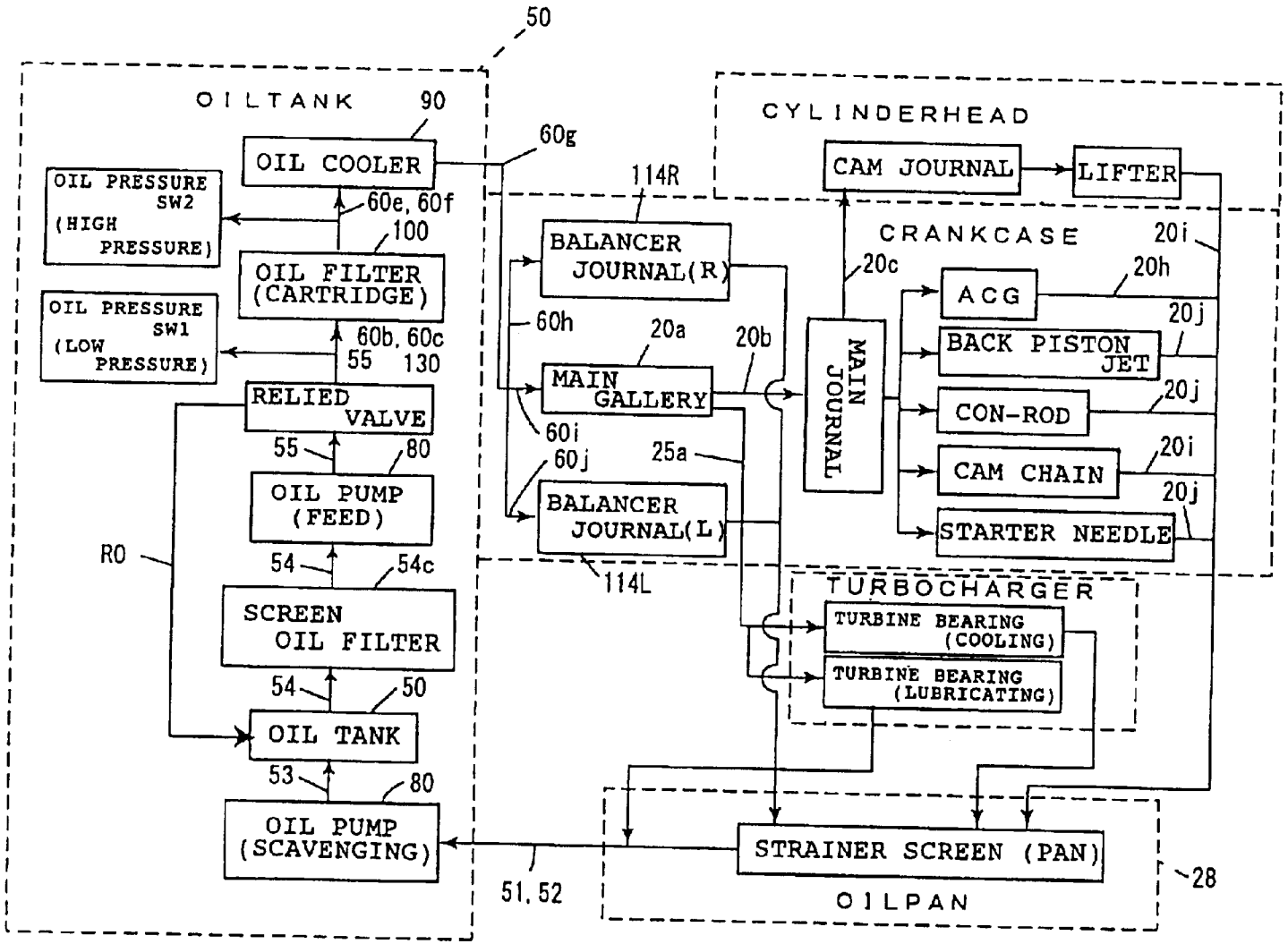
FIG. 22 is a schematic view showing a circulation route for oil according to the present invention.
Figures 23A, 23B:
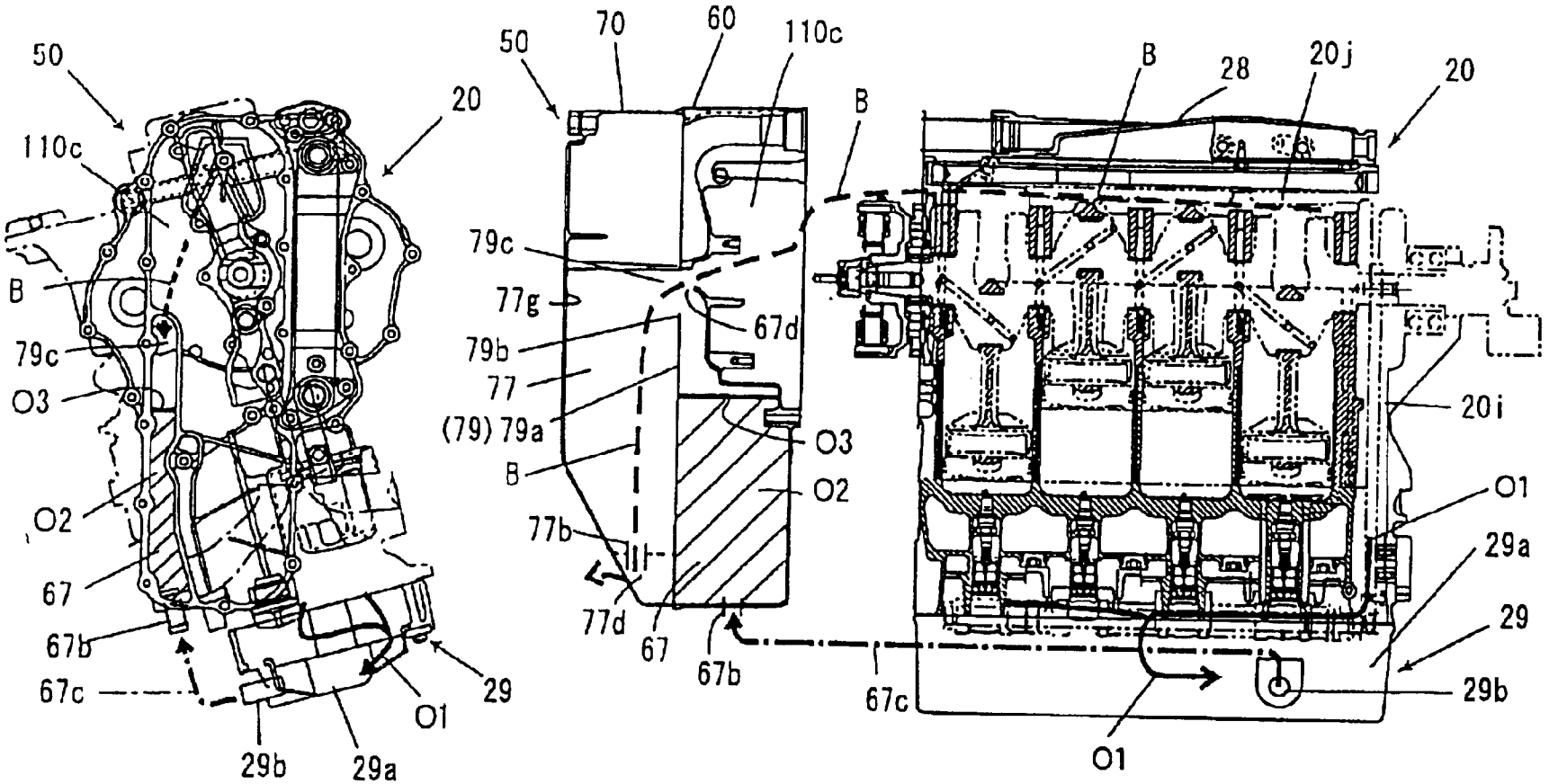
FIG. 23(*a*) is a schematic view of an engine and an oil tank when a watercraft in which the engine and oil tank is installed is in an overturned state.
Figures 24A, 24B:
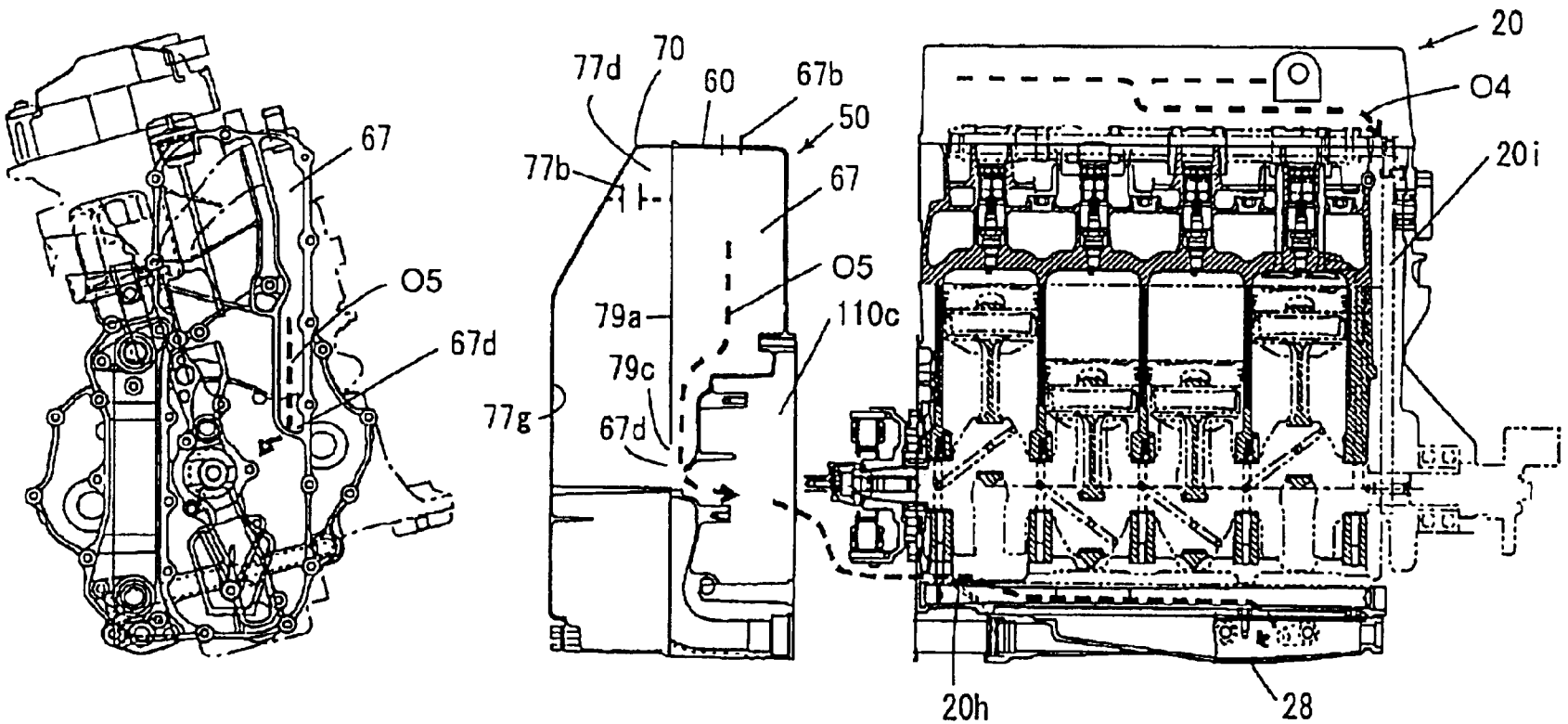
FIG. 24(*a*) is a front view showing an operational state of a return of oil when an overturned watercraft is restored to a normal, upright operating position.

17(*a*). FIG. 18(*a*) is a rear view of a cover according to the present invention. FIG. 18(*b*) is a side view showing the cover of FIG. 18(*a*) as viewed in the direction shown by the arrow b in FIG. 18(*a*). FIG. 18(*c*) is a cross sectional view taken along the line c—c in FIG. 18(*a*). FIG. 19 is a cross sectional view taken along the line IXX—IXX in FIG. 17(*a*). FIG. 20 is a partially enlarged view of FIG. 4. FIG. 21(*a*) is a front view of an oil pump according to the present invention. FIG. 21(*b*) is a cross sectional view taken along the line b—b in FIG. 21(*a*). FIG. 22 is a schematic view showing a circulation route for oil according to the present invention. FIG. 23(*a*) is a schematic view of an engine and an oil tank when a watercraft in which the engine and oil tank is installed is in an overturned state. FIG. 23(*b*) is a side view of the engine and oil tank shown in FIG. 23(*a*). FIG. 24(*a*) is a front view showing an operational state of a return of oil when an overturned watercraft is restored to a normal, upright operating position. FIG. 24(*b*) is a side view of FIG. 24(*a*).

As shown in FIGS. 1 to 3, a small, planing watercraft 10 can include a saddle-riding type, small vessel that an occupant seated on the seat 12 on the vessel body 11 can steer by gripping a steering handle 13 provided with a throttle lever. One of skill in the art will appreciate that the term boat, vessel and watercraft may be used interchangeably hereinafter.

A vessel body 11 is a floating structure formed by joining a hull 14 and a deck 15 so as to define a space 16 therein. In the space 16, an engine 20 is mounted on the hull 14, and a jet propulsion pump 30 driven by the engine is provided on the rear portion of the hull 14. The jet pump 30 includes a flow path 33 extending from an intake 17 opening on the vessel bottom to a jet flow port 31 opening at a rear end of the vessel body. The jet pump 30 also includes a nozzle 32, an impeller 34 disposed in the flow path 33, and a shaft 35 of the impeller 34 connected to an output shaft 21 of the engine 20. When the impeller 34 is rotated by the engine 20, water is drawn through the intake 17 and is then ejected from the jet flow port 31 through the nozzle 32. Accordingly, the vessel body 11 is propelled. The number of revolutions of the engine 20 and a resulting propulsion force by the jet pump 30 is controlled by rotating operation of the throttle lever 13*a* (See FIG. 2) of the operation handle 13. The nozzle 32 is linked to the operation handle 13 by an operation wire, and is rotated by the operation of the handle 13, to initiate a change in vessel course. A fuel tank 40 and a storage chamber 41 are also shown.

FIG. 4 is is a partially enlarged cross sectional view taken along the line IV—IV in FIG. 1 and showing an engine 20 (partially omitted cross sectional view). FIG. 5 is a right side view of the engine 20. FIG. 6 is a left side view of the engine 20. FIG. 7 is a perspective view of the engine 20 and FIG. 8 is a partially enlarged view of FIG. 5.

The engine 20 is a DOHC, dry-sump, four-cycle engine of in-line, four-cylinder, construction in which the crankshaft 21 is disposed along the fore-and-aft direction of the vessel body 11, e.g., as shown in FIG. 1.

As shown in FIG. 4 and FIG. 7, a surge tank (intake chamber) 22 and an intercooler 23 in communication with the intake port are connected and disposed on the left side of the engine 20 when viewed with respect to the traveling direction of the vessel body 11. An exhaust manifold 24 in communication with the exhaust port is connected and disposed on the right side of the engine 20.

As shown in FIG. 6 and FIG. 7, a turbo charger 25 is disposed behind the engine 20. An exhaust outlet 24*o* of the exhaust manifold 24 is connected to the turbine section 25T of the turbo charger 25. The intercooler 23 is connected to the compressor section 25*c* with a piping 26 (See FIG. 7). In FIG. 7, the reference numerals and signs 23*a*, 23*b* designates cooling water hoses connected to the intercooler 23.

Exhaust air that rotated the turbine at the turbine section 25T of the turbo charger 25 is discharged through the piping 27*a*, a backflow prevention chamber 27*b* for preventing backflow of water, e.g., the entry of water into the turbo charger 25 or the like if the vessel has overturned, a water muffler 27*c*, and the piping 27*d* extending into the water flow generated by the jet pump 30 (as shown in FIG. 1 and FIG. 2).

As shown in FIG. 4 to FIG. 8, an oil pan 28 is provided below the crankshaft 21 on the lower part of the engine 20. In the front portion of the engine 20 (the traveling direction of the vessel body 11, and the left portion in FIG. 1 and FIG. 5), an oil tank 50 and an oil pump 80 are integrally provided on the extension of the crankshaft 21. The oil pump 80 is provided within the oil tank 50.

FIG. 9(*a*) is a bottom view of an engine block according to an embodiment of the present invention. FIG. 9(*b*) is a left side view of the engine block of FIG. 9(*a*). FIG. 10 is a plan view of an oil pan having a strainer attached thereon according to an embodiment of the present invention. FIG. 11 (*a*) is a partially enlarged view of FIG. 10. FIG. 11(*b*) is a cross sectional view taken along the line b—b in FIG. 11 (*a*). FIG. 12(*a*) is a plan view of an oil pan according to the present invention. FIG. 12(*b*) is a cross-sectional view taken along the line b—b in the FIG. 12(*a*). FIG. 13(*a*) is a plan view of a strainer according to the present invention. FIG. 13(*b*) is a bottom view of the strainer of FIG. 13(*a*). FIG. 13(*c*) is a cross-sectional view taken along the line c—c in FIG. 13(*a*);

As shown in FIG. 9, the engine 20 includes an upper case 20*m* and a lower case 20*n* split along a parting plane D. By fastening these cases 20*m*, 20*n* with fastening bolts 20*k*, a bearing hole 20*o* of the crankshaft 21 and bearing holes 20L, 20R of the balancer are formed that will be described hereinafter. The lowermost surface 20*p* of the lower case 20*n* is positioned at a position lower than a head portion 20*k*1 of the fastening bolt 20*k* and formed with an opening. The lowermost surface 20*p* forms a joint surface for the oil pan 28, e.g., a mounting face (20*p*) for the oil pan 28.

The mounting face 20*p* for the oil pan 28 is formed into a laterally elongated rectangular shape when viewed from the bottom (FIG. 9(*a*)), and is provided in the outside vicinity of the fastening bolt 20*k*. As shown in FIG. 10, the upper surface 28*p* for the oil pan 28 is formed with an opening so as to be adapted to the joint surface 20*p*, and therefore forms a joint surface (28*p*) with respect to the joint surface 20*p*.

The oil pan 28 itself is configured as shown in FIG. 12 and includes the joint surface 28*p* formed on the case. A mounting face 28*a* for a strainer 140 is located at a position one step lower than the joint surface 28*p* and an oil exit 28*o* formed at the front portion (left portion in FIG. 12) of the case. The oil exit 28*o* is provided at the front end portion of the case along the axial direction (left and right direction in FIG. 12) of the crankshaft 21. The oil exit 28*o* is provided in the vicinity of the bottom of the oil pan 28 at the front surface of the case and is in communication with the oil pump 80 via a joint pipe 52 (see FIG. 5).

As shown in FIG. 13, the strainer 140 includes a first plate 141, a second plate 142, and a screen 143 interposed between the first plate 141 and the second plate 142. The contours of second plate 142 and the screen 143 are similar, and the screen 143 is slightly smaller. As shown in FIG. 13(*c*), a strainer 140 is constructed in such a manner that the screen 143 is sandwiched by the first plate 141 and the second plate 142. As shown in FIG. 13(*b*) with an "x" mark, the first plate 141, the second plate 142, and the screen 143 are integrally joined by adhering (welding) 144 the peripheral edges of the second plate 142 and the screen 143. The first plate 141 is formed with a plurality (ten in the embodiment shown) of mounting holes 145. As shown in FIG. 12(*a*), the case of the oil pan 28 is formed with screw holes 28*b* on the mounting face 28*a* for the strainer 140 so as to align with the mounting holes 145.

The strainer 140, as shown in FIG. 10 and FIG. 11, is mounted integrally to the oil pan 28 by mating the first plate 141 with the mounting face 28*a* of the oil pan 28 with the mounting holes 145 aligned with the screw holes 28*b* and screwing the bolts 146 into the screw hole 28*b*. The outer peripheral portion forming the joint surface 28*p* for the oil pan 28 is formed with a plurality (14 in the figure) of mounting holes 28*c*. As shown in FIG. 9(*a*), the lower case 20*n* of the engine 20 is provided with screw holes 20*q* on the mounting face 20*p* of the oil pan 28 so as to align with the mounting holes 28*c*.

The oil pan 28 is mounted on the lower portion of the engine 20 by mating the joint surface 28*p* of the oil pan 28 with the mounting face 20*p* of the lower case 20*n* with the mounting holes 28*c* aligned with the screw holes 20*q*. Bolts or screws (not shown) are then screwed into the screw holes 20*q*. As is clear from the description above, and as shown in FIG. 5, the strainer 140 is provided in the vicinity of the joint surfaces 20*p*, 28*p* between the oil pan 28 and the engine 20 along the engaging surfaces 20*p*, 28*p*.

The oil tank 50 includes a tank body 60 to be joined on the front surface of the engine 20, and a cover 70 to be joined on the front surface of the tank body 60. FIG. 14(*a*) is a plan view of a tank body according to the present invention. FIG. 14(*b*) is a front view of the tank body of FIG. 14(*a*). FIG. 14(*c*) is a cross sectional view taken along the line c—c in FIG. 14(*b*). FIG. 14(*d*) is a cross sectional view taken along the line d—d in FIG. 14(*a*). FIG. 15 is a rear view of the tank body according to the present invention. FIG. 16(*e*) is a cross sectional view taken along the line e—e of FIG. 14(*b*). FIG. 16(*f*) is a cross sectional view taken along the line f—f in FIG. 14(*b*).

FIG. 17(*a*) is a front view of a cover according to the present invention. FIG. 17(*b*) is a cross sectional view taken along the line b—b in FIG. 17(*a*). FIG. 17(*c*) is a cross sectional view taken along the line c—c in FIG. 17(*a*). FIG. 17(*d*) is a cross sectional view taken along the line d—d in FIG. 17(*a*). FIG. 18(*a*) is a rear view of a cover according to the present invention. FIG. 18(*b*) is a side view showing the cover of FIG. 18(*a*) as viewed in the direction shown by the arrow b in FIG. 18(*a*). FIG. 18(*c*) is a cross sectional view taken along the line c—c in FIG. 18(*a*). FIG. 19 is a cross sectional view taken along the line IXX—IXX in FIG. 17(*a*). FIG. 20 is a partially enlarged view of FIG. 4.

As shown in FIG. 14 and FIG. 15, the tank body 60 includes a joint surface 61 with respect to the front surface of the engine 20, a joint surface 62 with respect to the cover 70, a mounting face 63 for the oil pump 80, a mounting portion 64 for a water cooled oil cooler 90, a generally elongated oil storage section 65 defined by the diaphragms forming these mounting faces and the outer wall, an ACG, a balancer shaft, and a cover portion 66 for the driving chamber of the starter motor. The tank body 60 also includes a first sub breather chamber 67 and a mounting portion 68 for the oil filter 100. A plurality of baffle plates 65*a* are formed in the oil storage section 65.

As seen in FIG. 5 and FIG. 8, an ACG rotor 110 is secured at the tip of the crankshaft 21 by a bolt 112 together with the coupling 111. The coupling 111 is coupled with the coupling fixed to the rear end of the pump shaft that will be described later. As seen in FIG. 4 and FIG. 5 a gear 113 for driving a balancer 114R is fixed on the backside of the ACG rotor 110. As shown in FIG. 4, the gear 113 drives the balancer 114R by being engaged with the balancer gear 115 fixed to the tip of the balancer 114R (See FIG. 6). The balancer is disposed in parallel with the crankshaft 21 in the right part (left side in FIG. 4) of the interior of the engine 20 via an idle gear 116, and simultaneously drives the balancer 114L in the opposite direction from the balancer 114R by being directly engaged with the gear 117 fixed to the tip of the balancer 114L. The balancer 114L is disposed in parallel with the crankshaft 21 in the left part (right side in FIG. 4) of the interior of the engine 20. As seen in FIG. 4, a starter motor 120 and the pinion gear 121 engage the starter gear 123 via the speed reducing gear 122. The starter gear 123 is connected to the crankshaft 21 via a one-way clutch 124, as shown in FIG. 5.

As shown in FIG. 14 and FIG. 15, the cover portion 66 of the tank body 60 includes an ACG cover portion 66*a* for covering the ACG rotor 110, the gear 113 for driving the balancer, and the starter gear 123. A coupling cover portion 66*b* for covering the coupling portion 111, a cover portion 66*c* for the right balancer driving system for covering the balancer gear 115 and the idle gear 116, a cover portion 66*d* for the left balancer driving system for covering the balancer gear 117, and cover portions 66*e* for the starter driving system for covering the pinion gear 121 and the speed reducing gear 122 of the starter motor 120 are also provided as shown. A hole 66*f* for supporting the shaft of the speed reducing gear 122 is also provided as shown.

As seen in FIG. 8, a pulsar 118 is provided on the outer periphery of the ACG for taking a pulse signal and is mounted on the coupling cover portion 66*b* in the ACG cover portion 66*a*. Therefore, the pulsar 118 overlaps the oil tank 50 with respect to the axial direction of the crankshaft 21. The joint surface 61 of the tank body 60 is joined to the front surface of the engine 20 in such a manner that the cover portion 66 covers the aforementioned respective parts. The cover portion 66 is integrally secured to the front surface of the engine 20 with a bolt (not shown). The tank body 60 is mounted to the front surface of the engine 20, after the oil pump 80 and the oil cooler 90 are mounted.

As shown in FIGS. 17 to 19, the cover 70 includes a joint surface 71 with respect to the tank body 60, an oil supply port 72, a relief valve holding portion 73, an oil cooler storage section 74, an oil storage section 75 defined by the outer wall and the diaphragm, and a second sub breather chamber 77. The oil storage section 75 is formed with a plurality of baffle plates 75*a*.

FIG. 21 is a drawing showing an oil pump 80, in which the figure (*a*) is a front view, the figure (*b*) is a cross sectional view taken along the line b—b in the figure (*a*).

As shown in FIG. 21 and FIG. 8, the oil pump 80 includes a first case 81 to be joined to the tank body 60, a second case 82 to be joined to the first case 81, a pump shaft 83 to be provided through the first and the second case, an inner rotor 84*a* connected to the pump shaft 83 in the first case 81 for colleting oil, an outer rotor 84*b* provided so as to be rotatable around the periphery of the inner rotor 84*a*, an inner rotor

85*a* connected to the pump shaft 83 in the second case 82 for supplying oil, an outer rotor 85*b* provided so as to rotate around the periphery of the inner rotor 85*a*. The reference numeral 86 designates a dowel pin (nib).

The inner rotor 84*a* and the outer rotor 84*b* for collecting oil constitute an oil collecting pump together with the first case 81, and the inner rotor 85*a* and the outer rotor 85*b* for supplying oil constitutes an oil supply pump with the first and the second cases 81, 82.

The oil pump 80 is assembled as shown in FIG. 21, then the first case 81 and the second case 82 are joined by a bolt 87, and then the joint surface 81*a* of the first case 81 with respect to the tank body 60 is joined to the joint surface 69 of the oil tank body 60 on its front surface in the same shape as the joint surface 81*a* (See FIG. 14(*b*), (*c*)), and subsequently, a bolt 88 (See FIG. 8) is inserted into the through port 80*a* mounted of the first and the second cases 81, 82 and the oil pump 80 is mounted on the front surface of the tank body 60 with this bolt 88.

After the oil pump 80 is mounted on the tank body 60, a coupling 89 is fixed to the rear end of the pump shaft 83 from the backside of the tank body 60 with a bolt 89*a*. FIG. 21(*a*) is a front view of an oil pump according to the present invention. FIG. 21(*b*) is a cross sectional view taken along the line b—b in FIG. 21(*a*).

After the oil pump 80 and its coupling 89 is mounted as described above, and the the oil cooler 90 is mounted as will be described hereinafter, the tank body 60 is mounted on the front surface of the engine 20 by connecting the coupling 89 with the aforementioned coupling 111. As shown in FIG. 6 and FIG. 14(*b*), the water-cooled oil cooler 90 is mounted on the front side of the mounting portion 64 of the tank body 60 for the oil cooler 90. The mounting portion 64 of the tank body 60 is formed with an upper hole 64*a* in communication with an oil passage that will be described hereinafter.

The oil cooler 90 includes, as shown in FIG. 6, a plurality of heat exchange plates 91 through which oil passes. An oil inlet pipe 92 in communication with the interior of the plate 91 at the upper portion thereof, an oil exit pipe 93 in communication with the same at the lower portion thereof and as shown in FIG. 20, and flanges 94, 95 for attachment on the tank body 60 are also included in the oil cooler 90. Therefore, the oil cooler 90 is mounted to the mounting portion 64 of the tank body 60 by fastening the flanges 94, 95 with bolts, not shown, with the inlet pipe 92 connected to the upper hole 64*a* of the tank body 60 and the exit pipe 93 connected to the lower hole 64*b* of the tank body 60 respectively. In FIG. 20, the reference numeral 96 designates a bolt insertion hole provided on the flanges 94, 95.

The tank body 60 is provided with a cooling water feed pipe 97 in communication with a hole 64*c* opening on the mounting portion 64 for feeding cooling water into the mounting portion 64 and the oil cooler storage section 74 in the cover 70. The cover 70 is provided with a water discharge pipe 78 as shown in FIG. 17 to FIG. 19. A cooling water hose 97*a* extending from the cooling water taking portion 30*a* (See FIG. 7) of the jet pump 30 is connected to the feed pipe 97 directly without any other cooling objective along the path. A drainpipe 23*c* is connected to the discharge pipe 78 as shown in FIG. 6. Water from the discharge pipe 78 is supplied to a water jacket of the engine 20 via the drainpipe 23*c*.

After the tank body 60, the oil pump 80, and the oil cooler 90 are mounted on the front surface of the engine 20. The cover 70 is joined and fixed on the front surface of the tank body 60 with bolts (not shown) with the rear end 131 of a relief valve 130 fitted into a hole 82*a*. The hole 82*a* is formed on the front surface of the second case 82 of the oil pump 80 and the tip 132 of the relief valve 130 held by the aforementioned holding portion 73 as shown in FIG. 8 and FIG. 21. As seen in FIG. 17(*a*), the bolt insertion holes 76 permit the relief valve 130 to be disposed transversely.

With the tank body 60 and the cover 70 joined, the oil storage sections 65 and the oil storage sections 75 on both define an elongated single oil storage section. In addition, by joining the tank body 60 and the cover 70, the aforementioned baffle plates 65*a*, 75*a* formed respectively in the oil storage sections facing with each other are joined together.

The oil filter 100 is attached on the mounting portion 68 of the tank body 60 for attaching the oil filter 100. With the engine 20 mounted on the vessel body 11, the engine 20 and the oil filter 100 face toward the opening 15*a* of the deck 15 as shown in FIG. 2 and FIG. 4. The opening 15*a* of the deck 15 is opened by removing the seat 12. The seat is specifically constructed to be detachable with respect to the vessel body 11.

As is described thus far, in a state in which the oil tank 50, including the tank body 60 and the cover 70, the oil pump 80, the oil cooler 90, and the relief valve 130 contained therein, is mounted on the front surface of the engine 20, and the oil filter 100 is attached thereon, the following oil passage(s) is/are defined. As shown in FIG. 8, an oil collecting passage 51 is formed by the front surface of the tank body 60 and the backside of the first case 81 of the oil pump 80. The collecting passage 51 includes an oil passage 51*a* formed on the side of the tank body 60 (see FIG. 14(*b*)), and an oil passage 51*b* formed on the side of the first case 81 of the oil pump 80 in an opposite position to the oil passage 51*a*.

The lower end 51*c* of the oil collecting passage 51 is in communication with the oil exit 28*o* of the oil pan 28 of the engine 20 via the aforementioned joint pipe 52. The upper end 51*d* is in communication with the collected oil intake port 81*i* formed on the first case 81 of the oil pump 80. A collected oil discharge path 53 is formed by the front surface of the tank body 60 and the backside of the first case 81 of the oil pump 80. The collected oil discharge path 53 is formed by an oil passage 53*a* formed on the side of the tank body 60 (See FIG. 14(*b*)) and a collected oil discharge port 81*o* formed on the side of the first case 81 of the oil pump 80.

The upper end 53*b* of the collected oil discharge path 53 opens into the oil tank 50, e.g., within the oil storage section (See FIG. 14(*b*), FIG. 20). As shown in FIG. 8, an intake path 54 and a discharge path 55 for supplied oil are formed between the front surface of the first case 81 and the backside of the second case 82 of the oil pump 80. The lower end 54*a* of the intake path 54 opens in the oil tank 50, e.g., within the oil storage section. The upper end 54*b* is in communication with the supplied oil intake port 82*i* (See FIG. 21(*b*)) of the oil supply pump. The intake path 54 is attached with a screen oil filter 54*c*.

The lower end 55*a* of the discharge path 55 is in communication with the supplied oil discharge port 82*o* of the oil supply pump. The upper end 55*b* passes through the upper portion of the first case 81 and is in communication with the lateral hole 60*a* formed on the tank body 60 (See FIG. 14(*b*), FIG. 20). The lateral hole 60*a* is, as shown in FIG. 14(*b*) and FIG. 20, is in communication with the vertical hole 60*b* also formed on the tank body 60. The upper end 60*c* of the vertical hole 60*b* opens in a ring shape when viewed from the top on the mounting portion 68 for the oil filter 100 (See FIG. 14(*a*), FIG. 16(*e*)), and the oil intake passage 101 of the oil filter 100 (see FIG. 20) is brought into communication with the opening 60*c*.

The aforementioned mounting hole 82*a* for the relief valve 130 is opened to the discharge port 55, and the relief valve 130 is attached to the mounting hole 82*a* as described above. A male screw is provided at the oil exit pipe 102 in the oil filter 100, and the oil filter 100 is attached to the mounting portion 68 of the tank body 60 by screwing the oil exit pipe 102 into the female screw hole 60*d* formed at the mounting portion 68 on the tank body 60 (See FIGS. 14(*a*), (*b*), FIG. 16(*e*), and FIG. 20).

The mounting portion 68 is formed with a peripheral wall 68*a* integrally therewith, and an oil receiving portion 68*c* is formed by the peripheral wall 68*a* and the side wall surface 68*b* of the tank body 60 continuing thereto. Therefore, oil that may drop down when the oil filter 100 is attached or detached with respect to the mounting portion 68 is received in the oil receiving portion 68*c*. The oil is then returned into the oil tank from the female screw hole 60*d* or the opening 60*c*, and significant contamination of the interior of the vessel body is avoided.

As shown in FIGS. 14(*a*), (*b*), FIG. 16(*e*), and FIG. 20, the lower portion of the female screw hole 60*d* is formed with a vertical hole 60*e* and a lateral hole 60*f* in communication with the lower end of the vertical hole 60*e*. The lateral hole 60*f* is in communication with the inlet pipe 92 of the oil cooler 90 via the upper hole 64*a* at the aforementioned mounting portion 64 of the oil cooler 90 (See FIG. 6 and FIG. 20).

The aforementioned lower hole 64*b* of the tank body 60 to which the exit pipe 93 of the oil cooler 90 is connected is, as shown in FIG. 16(*f*), formed with an oil passage 60*g* in communication with the lower hole 64*b* and an oil distribution path 60*h* in communication with the passage 60*g*. In addition, a main gallery feed path 60*i* for feeding oil to a main gallery 20*a* (See FIG. 5) of the engine 20, a left balancer feed path 60*j* for feeding oil to the bearing portion of the aforementioned left balancer 114L, and a right balance feed path 60*k* for feeding oil to the bearing portion of the right balancer 114R are in communication with the oil distribution path 60*h*.

The feed paths 60*j, k* for the balancers 114 (L,R) are in communication with the oil distribution path 60*h*, respectively via a narrow path 60*m*. The feed paths 60*j, k* for the balancers 114 (L,R) are connected to the oil path 20*t*1, 20*t*2 that are in communication with the bearing portion 20L, 29R of the balancer 114 (L, R)m formed in the lower case 20*n* of the engine, shown in FIG. 6 and FIG. 9. An end 60*h*1 of the oil distribution path 60*h* is closed by the plug 60*n* (See FIG. 6).

The route of oil supplied to the main gallery 20*a* of the engine 20 is shown in FIG. 22 (oil circulation route diagram). The route from the main gallery 20*a* is generally divided into two main routes. The first route is a route through which oil is fed to the bearing portion of the crankshaft (crank journal) 21 via the route 20*b* (See FIG. 5). The second route is a route through which oil is fed from the rear end 20*a*1 of the main gallery 20*a* through the pipe 25*a* (See FIG. 7) to the turbine bearing of the turbo charger 25 for cooling and lubricating the same. Oil used for cooling and lubrication of the turbine bearing of the turbo charger 25 is collected in the oil pan 28 through the pipe 25*b*, 25*c* (See FIG. 6).

Oil fed to the bearing portion of the crankshaft 21 passes through the route 20*c* and lubricates the cam journal 20*d* portion and the lifter portion in the cylinder head. The oil then passes through the chain chamber 20*i* and back into the oil pan 28. Oil fed to the bearing portion of the crankshaft 21 is further fed to the ACG, a back-piston jet nozzle, a con-rod, a cam chain, and a starter needle, and then collected to the oil pan 28 trough the respective collecting paths.

In FIG. 5, a jet nozzle 20*e* for cooling the piston down by injecting oil to the backside of the piston, a passage 20*f* to the con-rod, and a cam chain 20*g*. An oil return path 20*h* from the ACG chamber is also provided. Oil in the ACG chamber is returned back to the oil pan 28 through the return path 20*h*. Oil injected from the jet nozzle 20*e* to the backside of the piston and oil fed to the con-rod and to the starter needle are returned back to the oil pan 28 through the crank chamber 20*j*, respectively.

As is clear from the description above, referring mainly to FIG. 22, a general flow of oil will be from the oil tank 50 to the intake path 54 through the screen oil filter 54*c* to the oil pump (feed pump) 80 and discharge path 55 (and relief valve 130, lateral hole 60*a*, vertical hole 60*b*, ring-shaped opening 60*c*) and to the oil filter 100. Oil then flows through the vertical hole 60*e*, to the lateral hole 60*f*, the oil cooler 90, the oil passage 60*g*, oil distribution path 60*h*, main gallery feed path 60*i*, left balancer feed path 60*j*, right balancer feed path 60*k*, main gallery 20*a*, and the left balancer 114L and right balancer 114R.

Relief oil RO from the relief valve 130 returns to the oil tank 50 directly. Oil fed to the left balancer 114L and the right balancer 114R passes through the crank chamber 20*j* and is filtered through the strainer 140, and then returns to the oil pan 28. Oil fed from the main gallery 20*a* to the aforementioned respective parts are filtered through the strainer 140 and then returned to the oil pan 28 in a manner described above.

Oil returned to the oil pan 28 is collected to the oil tank 50 through the joint pipe 52, the collecting path 51, the oil pump 80 (collecting pump), and the collected oil discharge path 53. Oil is then circulated along the aforementioned route from the intake path 54.

As described hereinabove, the tank body 60 is formed with the first sub-breather chamber 67, and the cover 70 is formed with the second sub-breather chamber 77. As shown in FIG. 14(*b*), the first sub-breather chamber 67 is isolated from the oil storage section 65 in the tank body 60 by a diaphragm 67*a*. As shown in FIG. 18(*a*), the second sub-breather chamber 77 is isolated from the oil storage section 75 of the cover 70 by a diaphragm 77*a*. These sub-breather chambers 67, 77 are elongated in the vertical direction.

The joint surface 62 on the tank body 60 and the joint surface 71 on the cover 70 are connected via a metal gasket 79 that is partially shown in FIG. 18(*a*). The metal gasket 79 is configured to coincide with the aforementioned joint surface 62 and the joint surface 71. However, the gasket 79 extends inwardly at the portions corresponding to the first sub-breather chamber 67 and the second sub-breather chamber 77. The extended portion 79*a* serves as a partition plate for fencing the first sub-breather chamber 67 off the second sub-breather chamber 77. However, the extended portion 79*a* does not separate the first sub-breather chamber 67 completely from the second sub-breather chamber 77, and the lower portion of the lower end 79*b* is opened. This opened portion 79*c* permits communication between the first sub-breather chamber 67 and the second sub-breather chamber 77.

The tank body 60 and the cover 70 is formed with breathing paths 67*h*, 77*h* (See FIG. 14(*b*), FIG. 18(*a*)) in the oil storage section at positions adjacent to the first and the second sub-breather chambers 67, 77. These breathing paths 67*h*, 77*h* form a single breathing path when the tank body 60 and the cover 70 are joined. The lower end of the breathing path 67*h* on the side of the tank body 60 is in communication with the interior of the cover portion 66 through the opening 67*i* (See FIG. 15). Accordingly, the oil storage section in the oil tank 50 has a breathing capability.

As shown in FIG. 14, the first sub-breather chamber 67 is provided at the upper portion thereof with an inlet pipe 67*b* for breathing gas in communication therewith. On the other hand, as shown in FIG. 4, the head cover 29 of the engine 20 is formed with a main breathing chamber 29*a* therein. In the head cover 29, the main breathing chamber 29*a* is reduced in size to a minimum capacity so as to minimize the overall height of the engine 20. The head cover 29 is provided with an exit pipe 29*b* for breathing gas. The exit pipe 29*b* is connected to the inlet pipe 67*b* of the first sub-breather chamber 67 with a breather pipe 67*c*.

As shown in FIG. 17(*a*) and FIG. 18, the second sub-breather chamber 77 is provided at the upper portion thereof with an exit pipe 77*b* for breathing gas in communication therewith. The exit pipe 77*b* is provided at a lower position than the inlet pipe 67*b* of the first sub-breather chamber 67. The exit pipe 77*b* is connected to the air inlet box (not shown) disposed on the upstream side of the turbo charger 25 in the air inlet system of the engine 20 by the breather pipe 77*c* (See FIG. 18(*c*)), so that breathing gas is restored in the air intake box.

As shown in FIG. 8, FIG. 14(*a*), FIG. 14(*b*), and FIG. 15, the first sub-breather chamber 67 is provided at the lower end with a return path 67*d* for returning oil separated in the first and the second sub-breather chambers 67, 77. The return path 67*d* is formed on the tank body 60 and is in communication with the ACG chamber 110*c*. Therefore, oil separated in the first and the second sub-breather chambers 67, 77 enters into the ACG chamber 110*c* through the return path 67*d*, then through the aforementioned return path 20*h*. The oil is then filtered by the strainer 140 and returned to the oil pan 28.

According to the breather structure as described above, breathing gas generated in the engine 20 enters into the main breathing chamber 29*a* in the head cover 29 during normal operation, then flows through the breather pipe 67*c* into the first sub-breather chamber 67, and then flows through the opening 79*c* at the lower end (communication path between the first sub-breather chamber 67 and the second sub-breather chamber 77) into the second sub-breather chamber 77. The gas then flows from the exit pipe 77*b* through the breather pipe 77*c* and is restored into the air intake box.

Oil separated in the process of passing through the first sub-breather chamber 67 and the second sub-breather chamber 77 returns to the oil pan 28 through the return path 67*d*, the ACG chamber 110*c*, and the return path 20*h*, as described above. Since this type of small planing boat is mainly used for leisure, it is susceptible to overturning very often due to the operation of the operator.

However, with the breather structure as described above, oil is prevented from flowing out of the oil passage into the engine 20, the oil tank 50, and so on in a manner described below. FIG. 22 is a schematic view showing a circulation route for oil according to the present invention. FIG. 23(*a*) is a schematic view of an engine and an oil tank when a watercraft in which the engine and oil tank is installed is in an overturned state. FIG. 23(*b*) is a side view of the engine and oil tank shown in FIG. 23(*a*). In FIG. 23(*b*), the engine 20 and the oil tank 50 is illustrated separately in the interest of clarity of a flow of oil and breathing gas.

As shown in FIG. 23, when the vessel 10 is overturned and the engine 20 and the oil tank 50 are upside down, oil that was mainly in the crank chamber 20*j* and the oil pan 28 of the engine 20 flows down to the main breathing chamber 29*a* as shown by the arrow O1. Oil that was in the oil pan 28 mainly flows down through the chain chamber 20*i* to the main breathing chamber 29*a*.

As is described before, since the capacity of the main breathing chamber 29*a* is minimized in order to minimize the overall height of the engine 20, oil in the engine 20 cannot be accommodated exclusively within the main breathing chamber 29*a*. Accordingly, oil flows into the first sub-breather chamber 67 through the breather pipe 67*c*. The reference numeral and sign O2 (shadowed portion) designates oil that has flowed into the first sub-breather chamber 67, and O3 designates the upper surface (oil surface). As shown in FIG. 23, though oil flows into the first sub-breather chamber 67, as described above, since the first sub-breather chamber 67 is isolated from the second sub-breather chamber 77 by the extended portion 79*a* of the metal gasket 79 (See FIG. 18(*a*)), it does not flow into the second sub-breather chamber 77.

The capacity of the first sub-breather chamber 67 and the lower end (upper end when overturned) 79*b* of the extended portion 79*a* of the metal gasket 79 are constructed so that oil does not flow into the second sub-breather chamber 77 when overturned. More specifically, the sum of the capacity of oil receiving portion in the first sub-breather chamber 67 defined by the inner wall surface of the tank body 60 and the extended portion 79*a* and the lower end (upper end when overturned) 79*b* of the metal gasket 79, and the capacity of the oil receiving portion formed by the upper portion (lower portion when overturned, which mainly includes the main breathing chamber 29*a* and the cylinder head portion) in the engine 20 is adapted such that oil does not flow into the second sub-breather chamber 77. Accordingly, the total quantity of oil circulating in the engine 20 and the oil tank 50 is adapted so that oil does not flow into the second sub-breather chamber 77 when overturned.

As described hereinabove, since oil does not flow into the second sub-breather chamber 77 when overturned, the situation in which oil goes toward the air intake box through the second-sub breather chamber 77, the exit pipe 77*b*, and the breather pipe 77*c* connected thereto will never arise. If oil flows into the breather pipe 77*c* connected to the exit pipe 77*b* of the second sub-breather chamber 77 when overturned, oil flowing into the breather pipe 77*c* may flow toward the air intake box when the vessel 10 is restored (returned to the normal posture). Accordingly, oil would then flow out from the air intake box into the vessel body, thereby contaminating the vessel body (which results in contamination of the surrounding environment. With the breather structure in this embodiment, since the situation in which oil flows into the breather box 77*c* leading to the air intake box in the case of overturning is prevented, oil is prevented from flowing out of the oil passage in the engine 20 and the oil tank 50. Accordingly, environmental contamination is prevented.

Since breathing gas is separated into vapor and liquid in the first and the second sub-breather chambers 67, 77, the separated oil flows through the return path 67*d* provided at the lower end of the first sub-breather chamber 67 into the ACG chamber 110*c* and back into the oil pan 28 through the aforementioned return passage 20*h*. If the vessel 10 is overturned as described above, oil attached to the wall surface 77*g* of the second sub-breather chamber 77 and oil in the lower end of the second sub-breather chamber 77 and the return path 67*d* flows toward the exit pipe 77*b* of the second sub-breather chamber 77. However, the oil quantity is a small quantity that flows along the inner wall surface 77*g* of the second sub-breather chamber 77.

Accordingly, in this embodiment, and as shown in FIG. 18, an oil receiving portion 77*d* for overturning situations is provided at the upper portion (lower portion when overturned) of the second breather chamber 77. The oil receiving portion 77*d* is defined by a shoulder 77*e* with respect to the opening 77*b*1 of the exit pipe 77*b* extending toward the second sub-breather chamber 77. The opening 77*b*1 is projected from the lower surface (upper surface when overturned) 77*f* of the shoulder 77*e*, and is not in contact with the inner wall surface 77*g* of the second sub-breather chamber 77.

Therefore, even when oil adhering to the wall surface of the second sub-breather chamber 77 and oil in the lower end of the second sub-breather chamber 77 and in the return passage 67*d* flows to the exit pipe 77*b* and along the inner wall surface 77*g* of the second sub breather chamber 77 when overturned, the oil is received and pooled in this oil receiving portion 77*d* and will not flow into the exit pipe 77*b*. Accordingly, oil is reliably prevented from flowing out of the vessel 10.

When the vessel is overturned, the engine 20 may continue to rotate in many cases. If no countermeasure is taken under such a situation, as described hereinabove, problems may be encountered. Oil flowing from the main breathing chamber 29*a* to the first sub-breather chamber 67 flows over the lower end (upper end when overturned) 79*b* of the extended portion 79*a* of the metal gasket 79 and into the second sub-breather chamber 77. This may occur due to the pressure of breathing gas that increases gradually in the engine 20 during the operation of the engine.

However, according to this embodiment, when the vessel is overturned, a breathing passage from the interior of the crank chamber 20*j* through the ACG chamber 110*c*, the return path 67*d*, the opening 79*c* of the metal gasket 79, the second sub-breather chamber 77, the exit pipe 77*b* thereof, and a breather pipe 77*c* to the air intake box is formed as shown by the broken line B in FIG. 23. Accordingly, the return path 67*d* serves as a breathing passage at the time of vessel overturning.

FIG. 24(*a*) is a front view showing an operational state of a return of oil when an overturned watercraft is restored to a normal, upright operating position. FIG. 24(*b*) is a side view of FIG. 24(*a*). As shown in FIG. 24, when the overturned vessel 10 is restored to a normal operating position, oil which was in the upper portion (lower portion when overturned) of the engine 20 flows downward to the oil pan 28. Oil that was in the main breathing chamber 29*a* flows mainly through the chain chamber 20*i* back to the oil pan 28 as shown by the arrow O4 in FIG. 24(*b*). Oil that was in the breather pipe 67*c* may return to the oil pan 28 through the main breathing chamber 29*a* or flow to the first sub-breather chamber 67 depending on the state of inclination of the first sub-breather chamber 67.

Oil in the first sub-breather chamber 67 returns to the oil pan 28 through the return path 67*d*, the ACG chamber 110*c*, and the return path 20*h* as shown by the arrow O5. Oil that was in the oil receiving portion 77*d* in the second sub-breather chamber 77 flows along the inner wall surface 77*g* of the second sub breather chamber 77, and then flows back to the oil pan 28 through the opening portion 79*c*, the return path 67*d*, the ACG chamber 110*c*, and the return path 20*h*. The vessel 10 is therefore restored in the aforementioned or similar manner.

According to the dry-sump engine for a small planing boat described above, the following effects will be achieved. Since the engine 20 for driving the jet propulsion pump 30 is arranged in the vessel body 11 surrounded by the hull 14 and the deck 15 so that the crankshaft 21 thereof extends along the length of the vessel body (fore-and-aft direction), and the mounting face 20*p* for the oil pan 28 is provided in the vicinity of the outside of the fastening bolt 20*k* for fastening the upper case 20*m* and the lower case 20*n* of the engine 20 that support the crankshaft 21 when viewed from the bottom, the overall height of the engine 20 is reduced.

If the mounting face 20*p* for the oil pan 28 is provided inside the fastening bolt 20*k* when viewed from the bottom, the capacity of the oil pan 28 is reduced. If it is provided outside the fastening bolt 20*k* at a distance therefrom, the width of the oil pan 28 increases, and thus it can hardly be fitted to the configuration of the vessel. Further, if the mounting face 20*p* for the oil pan overlaps the fastening bolt 20*k* when viewed from the bottom, the overall height of the engine is correspondingly increased.

In contrast, according to this dry-sump engine for a small planing boat of the present invention, since the mounting face 20*p* for the oil pan is provided in the outside vicinity of the fastening bolt 20*k* when viewed from the bottom, the overall height of the engine 20 is reduced. In addition, the oil pan may be provided while securing an appropriate capacity, being adapted to the bottom of the vessel body, and securing an appropriate clearance with respect to the vessel body.

Since the engine 20 for driving a jet propulsion pump 30 is disposed in the vessel body 11 surrounded by the hull 14 and the deck 15, the engine 20 is provided with an oil pan 28 below the crankshaft 21. A strainer 140 is provided in the vicinity of the engaging surfaces 20*p*, 28*p* between the oil pan 28 and the engine 20 along the engaging surfaces 20*p*, 28*p*. Accordingly, the overall height of the engine 20 may be reduced while securing the area of the strainer (oil filtering area).

Since the strainer 140 is provided integrally with the oil pan 28, the strainer 140 can be mounted simultaneously with the oil pan 28. Since the portion in the vicinity of the bottom of the oil pan 28 and an oil pump 80 provided at the end of the crankshaft 21 are brought into communication with each other with a joint pipe 52, oil filtered through the strainer 140 is directly guided into the oil pump 80. Accordingly, the entry of foreign or contaminated matter to the oil pump 80 is prevented, thereby improving durability of the oil pump 80.

Since the oil pump 80 is provided at the end of the crankshaft 21, and an oil exit 28*o* in communication with the oil pump 80 is provided on the oil pan 28 at the end in the axial direction of the crankshaft 21, the overall height of the engine 20 can be reliably reduced in comparison with the case where the oil exit 28*o* is provided, e.g., at the bottom of the oil pan 28. Since the engine 20 for driving the jet propulsion pump 30 in the vessel body 11 is surrounded by the hull 14 and the deck 15 along the length of the vessel body, the oil tank 50 is disposed on the extension of the crankshaft 21 of the engine 20, and the oil pump 80 is driven by the crankshaft 21 disposed in the oil tank 50, the oil piping structure can be simplified.

Since the relief valve 130 for controlling the discharge pressure of the oil pump 80 is provided in the oil tank 50, relief oil from the relief valve 130 is discharged into the oil tank 50. Therefore, the capacity of the oil pump 130 can be reduced in comparison with the one in which relief oil 130 is discharged into the engine 20 (for example, into the oil pan). Therefore, the capacity of the oil pan 28 can be reduced and the overall height of the engine 20 can further be reduced.

Since the oil tank 50 includes the tank body 60 and the cover 70, and the relief valve 130 is passed through the discharge path 55 of the oil pump 80 and stored in the oil tank 50 so as to abut against the cover 70, the relief valve 130 can be easily stored and fixed. Since the tank body 60 and the cover 70 are joined and integrated at the substantially vertical engaging surfaces 62, 71 with each other, and the relief valve 130 is stored horizontally, the relief valve 130 can be assembled easily.

Since the oil pump 80 is stored on the side of the tank body 60 of the oil tank 50 and the intake, and discharge paths 51, 53, 60*a*, 60*b* are formed integrally with the tank body 60, the piping structure for oil may further be simplified. Since the tank body 60 covers the driving chamber for auxiliary equipment of the engine 20 such as the ACG, the balancer shaft 114, the starter motor 120, and the like, the specific cover for covering the driving chamber for the auxiliary equipment is not necessary, and the engine can be further downsized. In addition, the number of components can be reduced and the sound absorbing effect of the oil is expected in comparison with an independent cover that may induce or increase the sound emission of the engine 20.

Since the oil filter in communication with the oil pump 80 in the oil tank 50 is provided at the upper portion of the oil tank 50, and the communication paths 60*a*, 60*b*, 60*e*, 60*f* between the oil tank 50 and the oil filter 100 are formed by the oil tank 50, the piping structure for oil can be further simplified. Since the oil filter 100 faces toward the opening 15*a* of the deck 15, replacement of the oil filter 100 can be performed easily.

Since the breather chambers (in this embodiment, the first sub-breather chamber 67 and the second sub-breather chamber 77) for a dry-sump engine in which the oil tank 50 for storing engine oil is provided independently of the engine 20 is isolated and formed in the oil tank 50, and the breather chambers (67, 77) are in communication with the engine 20, it is not necessarily required to provide a breather chamber in the head cover 29 or the like of the engine 20. Even if the breather chamber is provided in this location, the capacity thereof can be reduced significantly. Accordingly, the capacity of the main breathing chamber 29*a* in the head cover 29 is significantly reduced.

Therefore, the entire engine's 20 size, especially the overall height thereof can be reduced, and a four-cycle engine 20 can be stored in the small vessel body 11 without the problems identified by the inventors with respect to the background art. Accordingly, a small vessel 10 with low pollution and low noise characteristics can be provided.

Since the oil tank 50 includes a divided cases 60, 70 joined together, and the breather chambers (67, 77) are formed by joining the divided cases 60, 70, the capacity/configuration of the breather chamber can be freely and easily determined and implemented. The inlet 67*b* of the breathing gas into the breather chambers (67, 77) is provided at the upper portion of the oil tank 50, and the exit 77*b* of the breathing gas is provided at a position lower than the inlet 67*b*. In addition, the return path 67*d* for returning oil separated in the breather chambers (66, 67) is provided in the oil tank 50 (in this embodiment, in the tank body 60). Accordingly, a high capability of vapor-liquid separation of breathing gas in the breather chambers (67, 77) is ensured, and separated oil can be returned easily to the oil tank 50.

The divided cases 60, 70 are joined via a gasket 79, and the breather chamber (67, 77) is partially isolated by the gasket 79 to define the first breather chamber 67 and the second breather chamber 77. The inlet 67*b* is formed on the first breather chamber 67 and the outlet 77*b* is provided on the second breather chamber 77. Accordingly, vapor-liquid separation is reliably performed. Since the oil tank 50 forms the cover portion 66*a* of the ACG disposed at the end of the crankshaft 21 of the engine 20, the number of components can be reduced and the sound absorbing effect by oil achieved in comparison with the independent cover that may easily reduce the sound emission of the engine 20.

Since a pulsar 118 for extracting a signal out is provided on the outer periphery of the ACG, and the pulsar 118 overlaps the oil tank 50 in the axial direction of the crankshaft 21, it is not necessary to extend the axial length of the engine 20 for accommodating the pulsar 118. Accordingly, a compact engine is provided. Since the storage sections 64 and 74 for the water-cooled oil cooler 90 are formed integrally with the oil tank 50, the piping for oil and the piping for cooling water may be simplified.

Since the oil tank 50 is provided with the oil filter 100, and the oil cooler 90 is interposed in the oil passage extending from the oil filter 100 to the main gallery 20*a* of the engine 20, the coolest oil is supplied to the main gallery 20*a* of the engine 20. Therefore, the engine 20 is efficiently cooled. Since the engine 20 is an engine mounted on the small vessel for driving the jet pump 30, and cooling water from the cooling water taking portion 30*a* of the jet pump 30 is supplied firstly to the storage section 74 for the water-cooled oil cooler 90, not only oil passing in the oil cooler 90, but also oil stored in the oil tank 50 is efficiently cooled.

Since the engine 20 is mounted on the small vessel and the breather chambers (67, 77) form an oil receiving portion when the vessel is overturned, the outflow of oil during an overturning situation is prevented. Since the engine 20 is mounted on the small vessel, and the return path 67*d* forms a breathing path when the vessel is overturned, the outflow of oil in the case of overturning can be reliably prevented. Since the engine 20 is mounted on the small vessel and the oil receiving portion 77*d* for oil backflowing through the return path 67*d* when the vessel is overturned is provided at the upper portion (the lower portion when overturned) of the second breather chamber 77, the outflow of oil is further reliably prevented. Since the oil storage section in the oil tank 50 is vertically elongated, aeration of oil due to lateral G during travel of the vessel 10 is reduced. Since the baffle plates 65*a* and 75*a* are provided in multistages in the oil storage portion, aeration of oil due to vertical G during travel of the vessel 10 is also reduced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A dry-sump engine for a planing boat having a jet propulsion pump, said dry sump engine comprising:

a crankshaft extending along an axial centerline of said engine;

an upper case and a lower case of said dry-sump engine;

at least one fastening bolt securing said upper case and said lower case of the engine along a parting plane;

an oil pan, said lower case including a mounting face for joining a joint surface of an oil pan and being provided in a position below said parting plane, wherein said fastening bolt is positioned higher than said oil pan with respect to said parting plane and said mounting face surrounds said at least one fastening bolt when viewed with respect to a bottom portion of said lower case and said engine centerline;

an oil tank; and an oil pump; wherein said oil pan is positioned below said crankshaft and said oil tank and said oil pump are integrally provided on an extension of said crankshaft.

2. The engine according to claim 1, wherein the oil pump is provided within the oil tank.

3. The engine according to claim 1, wherein the mounting face for the oil pan is formed into a laterally elongated rectangular shape when viewed from the bottom with respect to said lower case and said engine centerline.

4. A dry-sump engine for a planing boat having a jet propulsion pump, said dry sump engine comprising:

a crankshaft extending along an axial centerline of said engine;

an upper case and a lower case of said dry-sump engine;

at least one fastening bolt securing said upper case and said lower case of the engine along a parting plane;

an oil pan, said lower case including a mounting face for joining a joint surface of an oil pan and being provided in a position below said parting plane, wherein said fastening bolt is positioned higher than said oil pan with respect to said parting plane and said mounting face surrounds said at least one fastening bolt when viewed with respect to a bottom portion of said lower case and said engine centerline; and a strainer, a mounting face for the strainer located at a position lower than the mounting surface for joining said oil pan to said lower case, and an oil exit formed at a front portion of the lower case with respect to said crankshaft and in fluid communication with an oil pump via a joint pipe.

5. The engine according to claim 4, said strainer including a first plate, a second plate, and a screen interposed between the first plate and the second plate.

6. The engine according to claim 4, wherein the oil pan is mounted on the lower case of the engine by mating the joint surface of the oil pan with the mounting face of the lower case with a plurality of mounting holes aligned with screw holes, respectively, and said strainer is provided in the vicinity of the joint surfaces between the oil pan and the engine along the mounting face.

7. In combination, a dry-sump engine and a planing boat, said engine driving a jet propulsion pump for said planning boat and being arranged in a vessel body of said boat and surrounded by a hull and a deck, said engine comprising:

a crankshaft extending along a length of the vessel body and in parallel with a centerline of said engine;

an upper case and a lower case of said dry-sump engine;

at least one fastening bolt securing said upper case and said lower case of the engine along a parting plane;

an oil pan, said lowercase including a mounting face for joining a joint surface of an oil pan and being provided in a position below said parting plane, wherein said fastening bolt is positioned higher than said oil pan with respect to said parting plane and said mounting face surrounds said at least one fastening bolt when viewed with respect to a bottom portion of said lower case and said engine centerline; and a strainer, a mounting face for the strainer located at a position lower than the mounting surface for joining said oil pan to said lowercase, and an oil exit formed at a front portion of the lower case with respect to said crankshaft and in fluid communication with said oil pump via a joint pipe.

8. The dry-sump engine for the planing boat according to claim 7, said strainer including a first plate, a second plate, and a screen interposed between the first plate and the second plate.

9. The dry-sump engine for the planing boat according to claim 8, wherein the oil pan is mounted on the lower case of the engine by mating the joint surface of the oil pan with the mounting face of the lower case with a plurality of mounting holes aligned with screw holes, respectively, and said strainer is provided in the vicinity of the joint surfaces between the oil pan and the engine along the mounting face.

10. The dry-sump engine for the planing boat according to claim 7, wherein the oil pan is mounted on the lower case of the engine by mating the joint surface of the oil pan with the mounting face of the lower case with a plurality of mounting holes aligned with screw holes, respectively, and the strainer is provided in the vicinity of the joint surfaces between the oil pan and the engine along the mounting face, said strainer integrally secured to said oil pan.

11. The dry-sump engine for the planing boat according to claim 7, wherein the strainer is integrally secured to said oil pan.

* * * * *